US006006671A

United States Patent [19]

Yunan

[11] Patent Number: 6,006,671

[45] Date of Patent: Dec. 28, 1999

[54] HYBRID SHOCK TUBE/LEDC SYSTEM FOR INITIATING EXPLOSIVES

[76] Inventor: Malak Elias Yunan, 105 Kingsland Rd., Boonton Twp., N.J. 07005

[21] Appl. No.: 08/724,085

[22] Filed: Sep. 30, 1996

Related U.S. Application Data

[63] Continuation-in-part of application No. 08/393,719, Feb. 24, 1995, abandoned.

[51] Int. Cl.[6] ..... C06C 5/06; C06C 5/00

[52] U.S. Cl. ..... 102/275.11; 102/275.1; 102/275.7; 102/275.9; 102/275.12

[58] Field of Search ..... 102/275.9, 275.11, 102/275.12, 275.1, 275.2, 275.3, 275.4, 275.5, 275.6, 275.7, 275.8, 318, 322, 331, 332

[56] References Cited

U.S. PATENT DOCUMENTS

| | | | |
|---|---|---|---|
| Re. 31,953 | 7/1985 | Calder, Jr. et al. | 102/318 |
| 2,388,309 | 11/1945 | Curtiss | 102/275.1 |
| 2,952,206 | 9/1960 | Becksted | 102/275.7 |
| 3,590,739 | 7/1971 | Persson | 102/275.1 |
| 3,614,928 | 10/1971 | Partridge et al. | 102/275.5 |
| 3,817,181 | 6/1974 | Persson et al. | 102/318 |
| 3,987,732 | 10/1976 | Spraggs et al. | 102/275.11 |
| 4,060,033 | 11/1977 | Postupack et al. | 102/318 |
| 4,133,247 | 1/1979 | Calder, Jr. et al. | 102/318 |
| 4,232,606 | 11/1980 | Yunan | 102/275.1 |
| 4,248,152 | 2/1981 | Yunan | 102/275.7 |
| 4,295,424 | 10/1981 | Smith et al. | 102/322 |
| 4,328,753 | 5/1982 | Kristensen et al. | 102/275.5 |
| 4,343,663 | 8/1982 | Breza et al. | 102/204 |
| 4,369,688 | 1/1983 | Yunan | 102/275.8 |
| 4,424,747 | 1/1984 | Yunan | 102/275.7 |
| 4,493,261 | 1/1985 | Simon et al. | 102/275.8 |
| 4,527,482 | 7/1985 | Hynes | 102/331 |
| 4,607,573 | 8/1986 | Thureson et al. | 102/275.8 |
| 4,699,059 | 10/1987 | Kelly et al. | 102/275.7 |
| 4,718,345 | 1/1988 | Yunan | 102/275.3 |
| 4,799,428 | 1/1989 | Yunan | 102/275.3 |
| 5,327,835 | 7/1994 | Adams et al. | 102/275.11 |
| 5,597,973 | 1/1997 | Gladden et al. | 102/275.11 |
| 5,629,493 | 5/1997 | Andersson et al. | 102/275.8 |
| 5,665,932 | 9/1997 | Viljoen et al. | 102/275.7 |

FOREIGN PATENT DOCUMENTS

| | | | |
|---|---|---|---|
| 92413 | 5/1938 | Sweden | 102/275.1 |
| 516869 | 1/1940 | United Kingdom | 102/275.12 |

*Primary Examiner*—Charles T. Jordan
*Assistant Examiner*—Theresa M. Wesson
*Attorney, Agent, or Firm*—Diamond C. Ascani

[57] ABSTRACT

In a non-electric system for initiating explosives, a shock tube is initiated by the detonation of a low-energy detonating cord (LEDC) whose wall has been placed adjacent to an initiation-sensitive region of a thin membrane in the shock tube, or in a capping member to an open end of a shock tube or in a capping member to the detonator itself, wherein the inner surface of the bore of the shock tube or the end-capping member is coated with a reactive composition of an explosive or a deflagrating compound. The end capping member fits over and seals the open end of the shock tube or fits in and seals a detonator with or without a shock tube in it, acting as a shock tube itself. The thin membrane accepts the detonation from the LEDC, whereby the shock tube or capping member is initiated and relays a pressure pulse to the shock tube or the detonator affixed thereto. Novel shock tubes, shock tube/detonator units, and a detonator for use in the hybrid shock tube/LEDC system are disclosed.

25 Claims, 9 Drawing Sheets

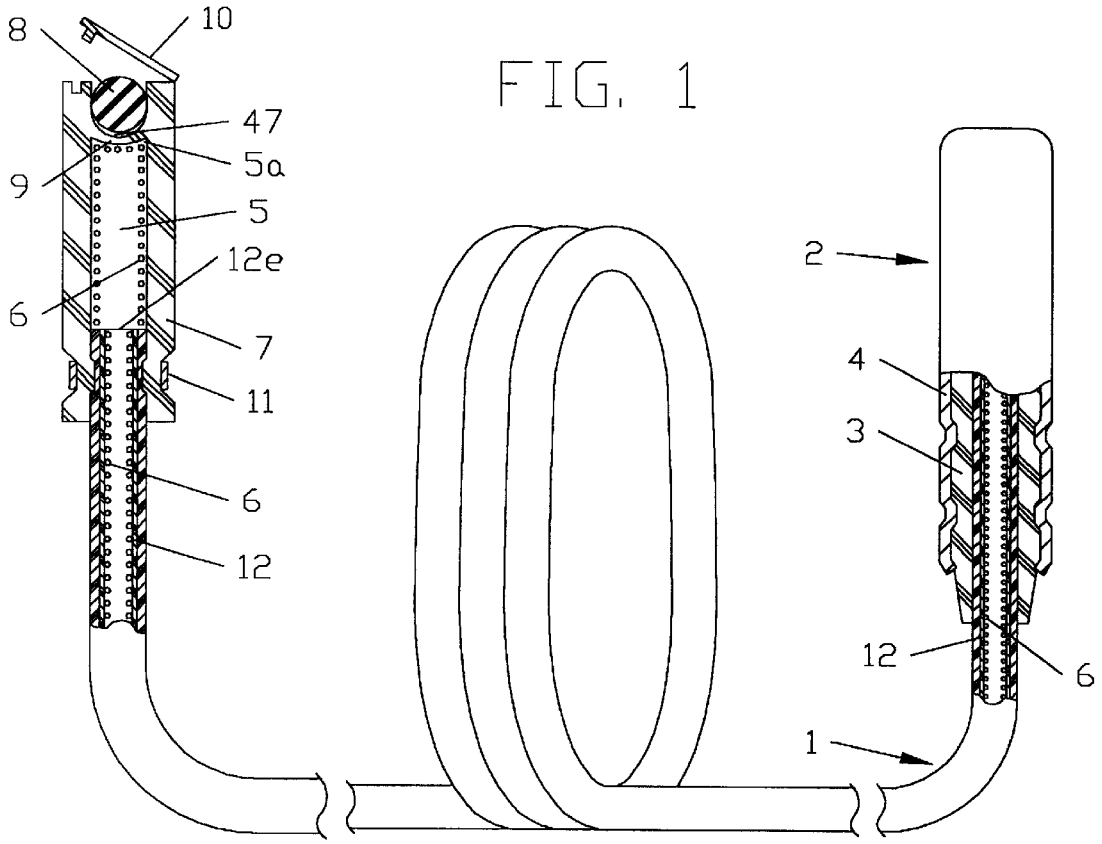
FIG. 1
FIG. 3
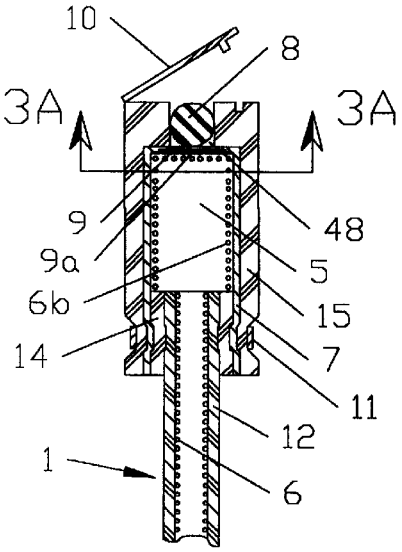
FIG. 3A
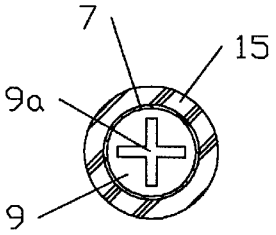
FIG. 4
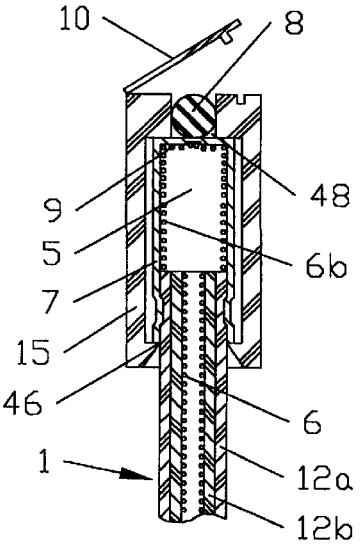

2
3
12
6
7
11
9
5
6a
23
4
22
3a
3b
17
17a
18
20
21
8
19

HYBRID SHOCK TUBE/LEDC SYSTEM FOR INITIATING EXPLOSIVES

This application is a continuation-in-part of my patent application Ser. No. 08/393,719, filed Feb. 24, 1995 now abandoned.

BACKGROUND OF THE INVENTION

1. Field of the Invention

The present invention relates to assemblies for initiating explosives by means of shock tube/detonator units, and to low-energy shock tubes and detonators adapted for use in such assemblies. The invention relates also to primer assemblies containing shock tube/detonator units for use in the non-electric initiation of cap-insensitive explosives, and more particularly for use in the delayed initiation of deck-loaded explosive charges by means of a single detonating cord downline.

2. Description of the Prior Art

A shock tube, or shock tubing, or a shock fuse, also known as fuses, impulse propagating tubing, signal transmission line, etc., is a low-energy shock tube which includes an elongated, hollow tube forming a gas channel, the inner surface of which tube is coated with a reactive substance, e.g., a thin layer of a detonating or deflagrating explosive composition. When the fuse is initiated at one end, a low-energy gaseous pressure, percussion or shock wave, pulse or signal is created, and propagated within the gas channel from one end of the tube to the other to actuate a shock tube detonator attached to the remote end of the tube. These definitions of the shock tube and the energy generated in the gas channel within the shock tube walls are used in different publications, but they all basically mean the same thing. As described in U.S. Pat. No. 3,590,739, the amount of reactive material on the inner surface of the fuse is so small that the tube is not perforated. Initiating of the shock tube is accomplished by such devices as a detonator, a delay detonator as described in U.S. Pat. No. 3,987,732, a percussion device as described in U.S. Pat. No. 5,327,835, an electric spark and detonating cords.

The need to reinforce the wall of the shock tube for one advantage or another has been recognized. Laminated, or multi-ply shock tubes are described, for example, in U.S. Pat. Nos. 4,328,753, 4,493,261, and 4,607,573. In these examples, each tube layer is made of a different plastic material to confer a required property, such as an outer layer made of a material having mechanical strength, and an inner layer of a material, such as Surlyn®, a polyethylene ionomer, to which the powdered reactive material, applied to the inner surface of the tubular composite, is adherent. Attempts to use a low-energy detonating cord (LEDC) in the middle and lower loading range to initiate shock tubes of any construction of wall thickness of about 1 millimeter and thicker were unsuccessful.

Shock tube/detonator units, wherein one end of the tube fits into a shock tube type detonator (see, for example, U.S. Pat. No. 3,817,181) are well-known in the blasting art, e.g., for use in initiating primers, as shown in U.S. Pat. No. 4,527,482. The latter patent makes reference to the prior art wherein such units, known commercially as Nonel Primadet®, a non-electric shock tube with a detonator, and HD Nonel Primadet®, a heavy-duty-type shock tube, where one end of the fuse or shock tube of these units, e.g., a 30-inch length of shock tubing, is crimped to a delay blasting cap (i.e., detonator) are used. The external end of the shock tube is initiated by, e.g., HD Primaline®, a heavy duty 1.6 grams per meter (7.5 grains per foot) detonating cord manufactured by the Ensign-Bickford Co. or by other higher-energy detonating cord. It is known to those skilled in the art that this cord will initiate the shock tube, especially when knotted in a double-wrapped square knot where its output is at least doubled at the knot. The same patent proceeds to teach how an external adapter to a primer wherein the adapter has different tunnels, is used to accommodate shock tubes/detonator units with different detonating cords. It is said that the smallest cord of 1.5 to 1.6 grams per meter (7 to 7.5 grains per foot) is to be confined with the shock tube in one tunnel, and higher-energy detonating cords of at least 18 grains per foot (3.8 grams per meter) in other tunnels for initiating shock tube/detonator units in the deck loading technique of blasting wherein a primer is positioned in each of a number of separated decks of cap-insensitive explosive, and wherein the primers are connected by a single downline detonating cord threaded through the adapter which is attached externally to each primer. The detonator of the shock tube is seated in an axial cavity in the primer, and the shock tube itself, called a pigtail, is inserted into one of the external adapter tunnels, depending on the amount of energy transmitted by the detonation from the detonating downline via the adapter, to initiate the shock tube. Sometimes a piece of another detonating cord, used to boost the detonation of the detonating cord, is inserted with the shock tube in the same tunnel of the shock tube to assure initiation. The purpose of this external adapter in U.S. Pat. No. 4,527,482 is that the recommended detonating cords, even the smallest mentioned, would either initiate the primer itself, or destroy it, or initiate the delay detonator instantly if inserted in the primer axial internal cord tunnel, thereby circumventing the required delay timing of the decks in the hole.

There are other patents addressing the same issue of placing the detonating cord outside the primer in a protective casing, tubes, or carriers and providing means of coupling the shock tube of the shock tube/detonator unit to the detonating cord. U.S. Pat. No. 4,133,247 is of particular interest since it states the problem of using detonating cords inside the primers. It uses 2.5 to 12.8 grams per meter (12 to 60 grains per foot) for reliable initiation of the shock tube when placed in the same external tunnel of a protective carrier for the primer.

The primer assembly described in U.S. Pat. No. 4,718,345 allows a detonating cord to be threaded through an axial cord tunnel of the primer by selecting a detonating cord in the middle to the low range of LEDC for a downline. Because of the low explosive loading of the preferred LEDC, i.e., about 0.5 gram per meter (2.3 grains per foot) of cord length, the mild initiation impulse from the output of the downline is amplified and relayed to the delay detonator seated in a cavity in the primer via an explosive coupler which is in initiating proximity to a percussion-sensitive element in the detonator, without adversely affecting the primer, or the detonator or the explosives in the bore hole. However, neither U.S. Pat. No. 4,718,345, nor any other patent or publication teaches how to use low-energy detonating cords of less than 1.5 grams per meter (7 grains per foot) to initiate shock tube systems without the added expense of a coupler, or a detonator.

SUMMARY OF THE INVENTION

The present invention provides an assembly for transmitting a detonation impulse to an explosive charge non-electrically comprising:

(a) a donor element comprising a length of low-energy detonating cord (LEDC) having an axial continuous core of a detonating explosive composition containing about from 0.1 to 1.3 grams of crystalline high explosive per meter length, or about from 0.5 to 6 grains per foot;

(b) a shock receptor-transmitter element comprising a tubular member adapted to accept and propagate a pressure or shock wave within a gas channel. The tubular member includes an elongated hollow tube forming a gas channel and having a wall coated on its inner surface with a reactive substance, wherein at least one section of said wall is thinned to form a thin region or membrane, and wherein this membrane is sensitive to initiation by the detonation of said LEDC when positioned in initiation relationship with the membrane;

(c) connecting means for positioning and retaining said length of LEDC in initiating relationship with the thinned-wall, initiation-sensitive region or membrane of said shock receptor-transmitter element; and (d) a non-electric shock tube-type detonator attached to the end of the shock receptor-transmitter element to form a shock tube/detonator unit.

In one embodiment of the assembly of the present invention, the shock receptor-transmitter tubular element is part of a shock tube having at least one section which has been thinned to form a membrane which is initiation-sensitive and is part of a length of an elongated hollow tube of a low-energy fuse of the shock tube type which has a wall coated on its inner surface with a reactive substance to propagate a pressure wave in the gas channel within the tube. The shock tube has at least one shock tube detonator attached to one or both ends of it.

In another embodiment of the assembly of the present invention the shock receptor-transmitter element is a tubular member comprised of an elongated hollow tube closed at one end so as to form an end-capping member, e.g., plug, with a bore. The wall of the bore is coated on its inner surface with a reactive substance which accepts and propagates a pressure wave in the gas channel within the bore and wherein at least one section of the wall of the bore has at least one groove thinning the wall to make that region of the wall an initiation-sensitive membrane, in which groove the LEDC is positioned and is retained in initiating relationship to the membrane, and wherein said grooves may be molded partly into the bore of the end-capping member to increase the thinned-wall area of the membrane and to increase transmission of detonation from the LEDC. Such end-capping member may be fitted:

(a) to a cut and open end of a length of shock tube which has a detonator attached to its other end. The end-capping member is attached to the wall of the shock tube thus making continuous gas channel between the bore of the end-capping member and the shock tube itself;

(b) partially into the open end of a shock tube detonator and sealed against the wall of the detonator with the bore of the end-capping member replacing the shock tube of the detonator at least beyond the open end of the detonator; or (c) to a cut and open end of a length of a shock tube which has a signal receiver at the other end to activate other explosive or non-explosive devices.

A critical feature of the assembly of the present invention is the matching of the thickness of the initiation-sensitive region or membrane with the core loading of the LEDC. Within the range of core loading of 0.1 to 1.3 grams per meter, the thickness of the membrane will be from 0.1 to 0.8 millimeter. The thickness in any particular case will depend on the loading of the LEDC; higher membrane thicknesses being used with higher core loading. The preferred range for the core load is 0.2 to 1.0 grams per meter and for the thickness of the initiation-sensitive membrane should be no greater than 0.8 millimeters, and more preferably, no greater than 0.5 millimeters.

Other embodiment of this invention include (a) a shock tube/detonator unit wherein the shock tube is sensitized for initiation by LEDC;

(b) a detonator unit wherein its end-capping means is sensitized for initiation by LEDC; and (c) a shock tube/detonator unit wherein the shock tube itself has an end-capping means sensitized for initiation by LEDC. Such a unit can be used in sliding primers in decked holes and as a detonator for the initiation of other cords or cap-sensitive explosives.

BRIEF DESCRIPTION OF THE DRAWING

In the accompanying drawing, which illustrates specific embodiments of the hybrid shock tube/LEDC system, and specifically the shock receptor-transmitter element, the initiation-sensitive membrane, the detonator, the shock tube/detonator unit, the detonation-transmitting assembly, and the primer assembly of the invention:

FIG. 1 is a perspective view in partial cross-section of a detonation-transmitting assembly of the invention wherein a cord end-capping member affixed to the open end of a length of shock tube places a length of LEDC adjacent a thinned-wall sensitive membrane at the closed end of the end-capping member which is the shock receptor-transmitter element;

FIG. 3 is a longitudinal cross-sectional view of a shock tube cord connector assembly of the invention with a length of LEDC in place adjacent a thin walled closed end of an end-capping capsule, which provides a bore with its internal wall coated with a reactive substance between the LEDC and the open end surface of the shock tube;

FIG. 3A is a view of the assembly of FIG. 3 taken along line 3A—3A;

FIG. 4 is a longitudinal cross-sectional view of assemblies of a shock tube and an end-capping capsule placed, e.g., field-assembled, as a unit into a cord connector;

FIG. 23A has a U shaped tube and FIG. 23B has a looped tube, both for use in a primer and FIG. 23C for use in a surface connector.

DETAILED DESCRIPTION

Figure 2:
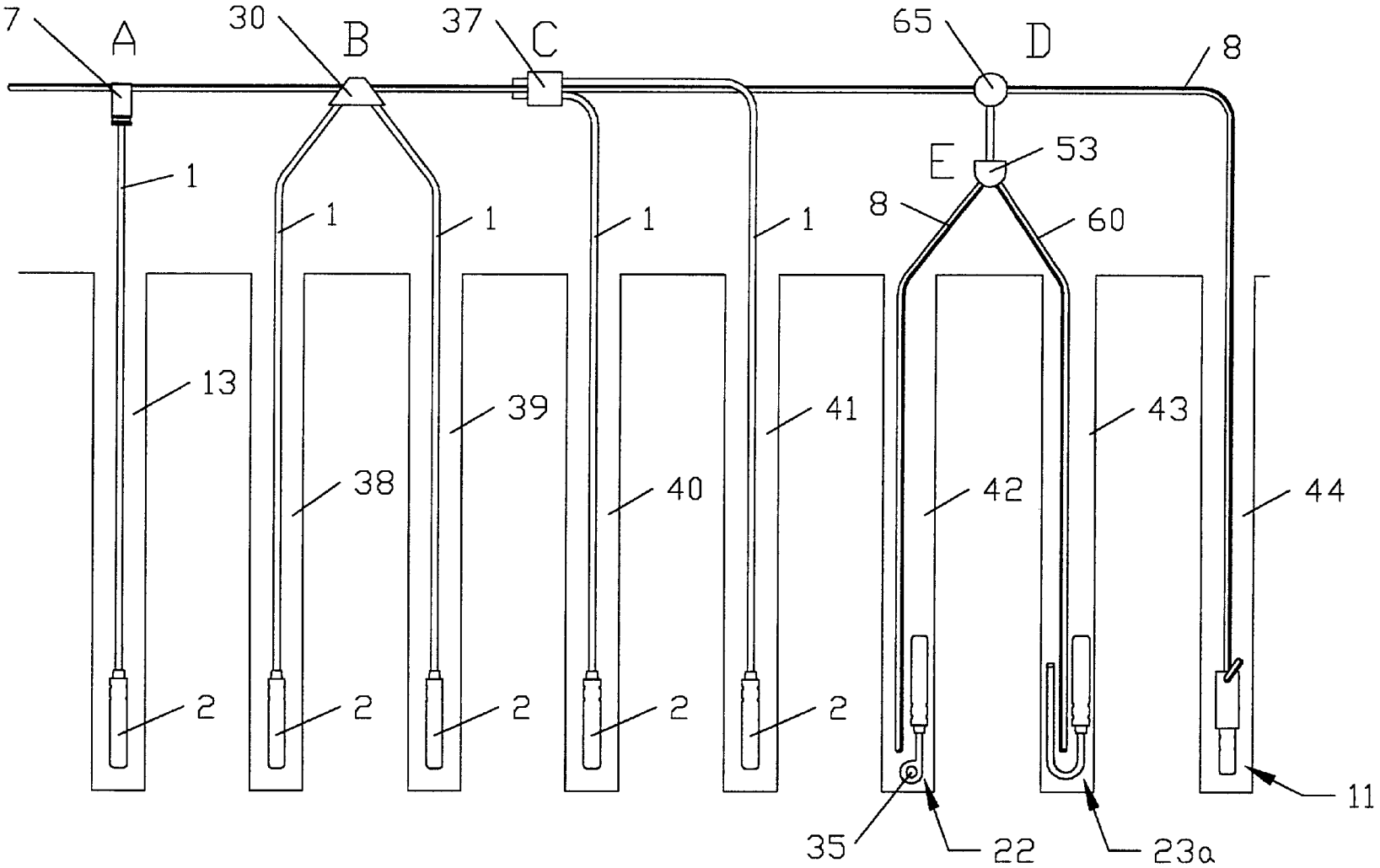
FIG. 2 is a schematic representation of four different detonation-transmitting assemblies of the invention wherein LEDC is used on the surface with four surface connectors to six shock tube detonator units, and in the hole to three more shock tube/detontor units where one of the four surface units of shock tube/detonator units is a surface connector used to initiate two LEDCs; and the three shock tube detonator units in the hole are initiated by three LEDCs.

In this present hybrid initiation system, the LEDC donor element comprises a length of a cord that may be used on the surface with shock tube/detonator units assemblies to make a hybrid LEDC/shock tube surface blasting system, or in the hole where the LEDC is used as a donor downline with shock tube/detonator assemblies to perform in-the-hole blasting. LEDC has an axial continuous core of a detonating explosive composition containing a crystalline high explosive compound in an explosive loading as low as about 0.1 grams (0.5 grains), usually in the range of about from 0.21 to 1.5 grams (1 to 7 grains), and no more than 2.1 grams per meter (10 grains per foot) of cord length. Other references consider the 1.5 grams per meter (7 grains per foot) as the starting point of the high-energy detonating cords. The main objective of this invention is to find a way to use a hybrid system of shock tube/LEDC assemblies wherein the LEDC is in the low to the middle range of loading of about 0.2 to about 1.0 gram per meter (1 to 4.7 grains per foot) without the use of intermediate couplers to boost their output, detonators or higher energy detonating cords for applications in the initiation of surface blasting systems and for applications in blasting bore holes especially with deck-loading of primers wherein an LEDC of the low to middle range as defined in this invention, can be threaded in the internal cord tunnels of such primers without any damage to the explosives in the hole, the primer itself, or the detonator in the primer. This invention provides a hybrid shock tube/LEDC system wherein a receptor-transmitter element including a shock tube has a thinned-wall, initiation-sensitive region or membrane to receive and propagate the detonation from LEDC with the desired core loading.

Shock tubes are low-energy fuses of the type which propagate a low-energy pressure wave within a gas channel and include an elongated hollow tubing having a wall coated on its inner surface with a reactive substance which can be a detinating or deflagrating explosive composition. Some of the detonating composition are based on, for example, PETN (pentaerythritol tetranitrate), RDX (cyclotrimethylenetrinitramine), HMX (cyclotetramethylenetetranitramine), etc. A list of some of the deflagrating compositions that are used in shock tubing or fuses with slower propagating rate than those in shock tubes with reactive substance based on detonating compositions are described in PCT/US 86/02752 (WO 87/03954). These deflagrating compositions are basically a fuel with an oxidizer mainly used as delay or as ignition powders. Their use in shock tubes of varying shock wave velocities or signal propagation rates are detailed in patent publication WO 87/03954.

In one aspect of this invention, the shock tube in the shock tube/detonator unit has at least one receptor-transmitter element, which in turn has at least one initiation-sensitive region or a thinned-wall initiation-sensitive membrane. It is known by those skilled in the art that LEDC of less than 1.5 grams per meter (7 grains per foot) will not reliably initiate shock tubes available on the market, regardless of their construction. Instead of using cords having a high energy output, i.e. HD Primaline® of 1.6 grams per meter (7.5 grains per foot) or more to initiate the shock tube through its thick wall, the present invention causes LEDC having a loading of less than about 1.3 grams per meter (6 grains per foot) to successfully initiate these shock tubes if the wall of the shock tube is thinned down at a specific location where the LEDC is put in initiation relationship with the thinned-wall, initiation-sensitive region, termed the receptor-transmitter element herein, which has a thin membrane built in it. More surprisingly, it was discovered that the shock will continue to propagate in the rest of the shock tube to eventually initiate the detonator. This invention can easily be demonstrated by shaving off some of the wall thickness, either by removing a layer or two of the multi-ply wall of the shock tube, or shaving some of the single thick layer of a shock tube at a small section and placing the LEDC with the desired low core load adjacent the initiation sensitive region of the receptor-transmitter element and initiating the LEDC.

When the receptor-transmitter element is part of a shock tube, then it is internally of the same construction. In this case, the wall of the shock tube needs to be thinned down at a region to become a receptor-transmitter element. When the receptor-transmitter element is part of a shock tube, the initiation-sensitive region or membrane, may be accomplished by simply thinning the wall of the shock tube to the desired thickness, or by manufacturing the tubing with thinned wall sections. If the end portion of the tube is the desired location for the receptor-transmitter element, then mechanical thinning can be done by stripping one or more of the multi-ply shock tube wall leaving a membrane wall of the desired thickness. Thinning down a section at the middle of the tube either longitudinally or circumferentially or even spirally can be accomplished by shaving, stripping or even using a lathe. Also, plastic melting techniques can be used to accomplish the same results including heat sealing ends and joining loops of the shock tube together as well as to the wall of the shock tube as discussed later. Normally, shock tubes wall thickness is about 1 millimeter (0.040 inches) throughout all its length. It was discovered that if the wall is thinned down to less than 0.8 millimeters (0.032 inches), and preferably from about 0.2 to about 0.5 millimeters (0.008 to 0.020 inches), then initiation at these receptor-transmitter can reliably be achieved with LEDC of about 0.5 to 1.0 gram per meter (2.3 to 4.7 grains per foot). Such thinned walls may be totally circumferential, as might be the case at the end of the shock tube which is not attached to the detonator, spiral or longitudinal for a short length of the tube and only for part of the circumference. The objective in all cases when creating a receptor-transmitter element or thinning the wall to create a membrane is to make the initiation-sensitive region as small as possible, without unduly weakening the total assembly to a failure point under field conditions.

All shock tubes are manufactured, and rightly so, rugged to withstand field use and abuse. That is one reason for introducing the multi-ply shock tubes. With this discovery of the hybrid shock tube/LEDC system, manufacturing shock tubes with wall thickness of less than about 0.8 millimeters (0.032 inches) fits the need of most applications of this invention since the LEDC is the rugged component to take all field use and abuse, which has been demonstrated successfully over the years, especially Detaline® cord, an extruded LEDC, easily manufactured with medium to low range of core loading. To be more specific, for example, the Detaline® cord could be used on the surface with all its surface connectors, as well as with other types of non-electric shock tube type surface components and connectors. These connectors could easily be converted to this present hybrid shock tube system which in turn will initiate either shock tubes or other Detaline® or other cords. Similarly, when Detaline® cord, or other equivalent LEDC, is used as a downline, all in-the-hole explosive components for Detaline® cord, as well as other non-electric shock tube type in-the-hole components, could easily be converted to this present hybrid shock tube system.

The present hybrid assembly of LEDC donor/receptor-transmitter element requires means for positioning the length of LEDC in initiating relationship with the initiation-sensitive region of the receptor-transmitter element so as to place the element, at least in part, in an initiation-sensitive relationship or mode with respect to the LEDC. The present invention teaches four basic initiation modes to make this hybrid system function as follows:

(a) The first is to direct the end output of the detonating cord into an open end of a shock tube/detonator unit. This can be accomplished by aligning both ends of the LEDC and the shock tube co-axially and joining them in place by taping or other means. Slipping both ends into a metallic sleeve or plastic tubing and securing the sleeves or the tubing over the LEDC over the shock tube with its open end opposite the LEDC did successfully initiation the shock tube even when spaced 1.3 centimeters (0.5 inches) away from the LEDC. The initiation in this mode is by end output of the LEDC and it is one-to-one initiation mode.

(b) The second mode is to run the LEDC adjacent to, and longitudinally parallel with, the longitudinal thinned-wall initiation sensitive region of the receptor-transmitter element of the shock tube. Means to hold the LEDC in initiation relationship with the thinned-wall, initiation sensitive region of the shock tube may be by taping, clamping, or closing two halves of a box with grooves to accept, for example, one LEDC and one shock tube side-by-side, or one LEDC and two shock tubes, one on each side of the LEDC, or one shock tube and two LEDC, one on each side of the shock tube with the initiation-sensitive region of the shock tube in initiation relationship with the LEDC. The initiation in this mode is by LEDC side output.

(c) The third mode is to wrap the LEDC around the initiation-sensitive region of the shock tube. One or more LEDC could be wrapped at least once around the initiation-sensitive regions of one or more shock tubes. The wrapped LEDC can be held in place by taping, a clip, a clamp or other devices. The initiation of the shock tube in this case is by side output of the LEDC concentrated circumferentially on the initiation-sensitive membrane of a length of the shock tube to concentrate the transmission of energy focally to the shock tube with initition-sensitive membrane.

(d) The fourth mode is to wrap one or more shock tubes with the initiation sensitive region around the LEDC in one or more wraps or turns. The wraps can be held in place by the same devices used in (c) above. The initiation of the shock tube in this case is by side output of the LEDC directed radially to the shock tube with initiation-sensitive membrane.

The term initiation-sensitive region of the receptor-transmitter element as used herein s denotes a thinned-wall thereof, and the receptor-transmitter element is in an initiation-sensitive mode with respect to a length of LEDC when positioned wall-to-wall adjacent the thinned-wall portion, i.e. the initiation-sensitive region of the shock tube is initiated from the output of the thus-positioned length of LEDC.

The present invention also provides (a) a shock tube having at least one initiation-sensitive region comprising a thinned-wall portion, (b) a shock tube/detonator unit wherein a length of said shock tube is attached to a detonator in a manner such that the thinned-wall portion is located in a section of said shock tube which is exposed beyond the confines of the detonator in the shock tube/detonator unit. At the thinned wall portion, where the wall thickness is less than about 0.8 millimeters (0.032 inches), the shock tube is sensitive to initiation through its wall from the side output of LEDC of about 1.3 grams per meter (6 grains per foot).

Another shock tube/detonator unit of this invention is one which has an end portion turned or folded back so as to form a closed loop by wall-to-wall fusion of its end surface to the outside of the shock tube wall, or by mechanical attachment to the shock tube wall. In each case, the wall of the shock tube in the portion thereof located inside the closed loop is thinned down sufficiently to render it initiation-sensitive from the side output of a length of donor LEDC which may be threaded through the loop aperture. When the other end portion of this shock tube is affixed to a detonator, a novel hybrid LEDC/shock tube/detonator unit adapted for attachment to, and initiation by a length of LEDC is formed for use on the surface or in-the-hole blasting.

The present invention also provides a receptor-transmitter element separately manufactured for the purpose of an end-capping member (i.e. end-capping plug) to be attached to (a) the open end of the shock tube, (b) to the end of a shock tube/detonator unit, or (c) to the shock tube detonator itself. It may be of a different construction than the shock tube. This receptor-transmitter element is also a tube that is not necessarily cylindrical in its outer shape, and has a bore which may be of any geometric shape, wherein the bore surface is coated with a reactive substance thus becoming by definition of this invention a shock tube per se. The reactive substance coating the bore of the end-capping means may be of explosive composition or deflagrating composition, both of which accept and propagate a shock wave in the gas channel within the bore of the end-capping member. At least one section of the wall of the end-capping member, or end-capping plug, is thinned to become an initiation-sensitive region to the output from an LEDC positioned in initiation relationship with the thinned-wall, initiation-sensitive region of the receptor-transmitter element or the end-capping means or plug. The outer surface of the receptor-transmitter element may have any geometric shape which is conveniently extruded, molded or machined with any length or shape to create a region with the preferred thinned-wall thickness of about 0.1 to about 0.5 millimeters (0.004 to 0.20 inches) without weakening the total structure.

The use of a deflagrating composition to coat the inner surface of the bore in the receptor-transmitter element, especially in the case of an end-capping means, or an end-capping plug, version of the invention, may be sometimes more desirable than detonating compositions. These deflagrating compositions are easier to initiate by LEDC under most conditions, and their slower rate of propagation may even be sometimes desirable to create a short delay in the detonator timing. There are many ways and means available for people skilled in the art to compound and to apply a detonating or deflagrating composition to the surface of the bore of the end-capping means or plug, starting at any point inside the opening of the bore, if need be. Just to mention a few: one simple way is to apply the appropriate amount of the composition, in dry powder form, close temporarily the opening of the bore and distribute the powder mechanically. The composition will stick to the surface of the bore especially if the powder is treated with a surfactant. Alternately, the end-capping member or its bore may be of suitable materials, which is an adherent to these powders like Surlyn® polyethylene ionomer, EVA (ethylene vinyl acetate) or EAA (ethylene/acrylate acid co-polymer). Another method may be to treat the surface of the inner wall chemically to accept such powders. Still another method is to slurry the powders and to apply the slurry, with or without additives, to enhance the adherence of the powder to the inner surface of the walls of the bore.

Proper placement of the donor LEDC with respect to the initiation-sensitive region of the receptor-transmitter element (or membrane) of the end-capping means, or end capping plug, as taught herein, is the key to achieving the initiation-sensitive relationship required of the donor and the receptor-transmitter element to enable the receptor-transmitter to be initiated by the LEDC. Once the receptor-transmitter element has been initiated, the shock tube/detonator, or the detonator attached directly to the receptor-transmitter itself becomes actuated, and in turn, initiates an explosive charge in which it has been positioned.

The end-capping means, or end-capping plug, has a bore with its inner surface coated with a reactive substance of explosive or deflagrating composition. When the bore is fitted against the outer walls of the shock tube, it protects the open end surface of the shock tube and acts as an extension to the gas channel in the shock tube. This end-capping member, or plug, may serve as a cord-connecting member as well, in which case its wall is molded or machined with apertures, grooves or slots for thinning the wall to create a thin membrane and for receiving a length of LEDC and placing it adjacent the thinned-wall initiation sensitive region in initiation-relationship with the receptor-transmitter member or membrane. The plug may have one or more thinned-wall, initiation-sensitive regions placed longitudinally, circumferentially, partly circumferentially or at the closed end of the plug.

The bore of the end-capping member may be molded in four different shapes to accomplish certain inventive objectives: (a) The bore may be larger than the outer diameter of the shock tube. In this case, the shock tube will be fitted inside the bore to a certain depth, and the end-capping member fixed to the shock tube wall. The larger internal diameter of the bore may be needed to increase the area of the thinned-wall membrane or improve retention of the LEDC in its groove, etc. In this case, spacers or sleeves may be used to match the outside diameter of the shock tube with the inside diameter of the bore; (b) The bore may be as described in (a) above, except that the bore gets reduced to a smaller diameter than the shock tube outside diameter to act as a stop for insertion depth of the shock tube into the bore, also to reduce the inside diameter of the bore. The use of this smaller inner diameter shock tube may have specific advantages with certain loading of reactive substances coating the surface of the bore; (c) The bore may be smaller than the outside diameter of the shock tube. In this case, another sleeve is needed to join the shock tube to the end-capping means. The advantage of this may be a smaller bore for specific requirements of certain reactive substances; (d) The bore may have an internal diameter matching the outside diameter of the shock tube for better fit and sealing of the end-capping means to the shock tube.

Also, the end-capping means may be made of two components or liners, one for the bore itself and the other for the rest of the body. Advantages are that different properties will be derived from this construction, for example, the bore itself being made of a metal shell, or a plastic shell with specific properties like adherence to powder as with EVA, Surlyn®, or the like, while the other liner or component surrounding the bore component can be made of any material being metal or plastic to fit certain properties such as strength, flexibility or rigidity, etc.

An inventive way to increase the area of the thinned-wall membrane and to improve the fit of the LEDC in its groove, thus increasing the initiation reliability of the receptor-transmitter element of molded plugs is to mold these LEDC retaining grooves deeper than the wall thickness of the end-capping means and slightly into the bore itself This can easily be accomplished with the external longitudinal grooves along the outer walls of the end-capping means, without interfering with the bore diameter sometimes needed to make a good seal against the exterior circular wall of the shock tube. When the initiation-sensitive region of the receptor-transmitter element is at the closed end of the end-capping means, about one-half of the circumference of the groove can be desirably molded into the end of the bore. When these grooves are circumferential, or partly circumferential, then only about one-quarter of the circumference of the top groove can be easily molded into the top of the cavity of the bore while other circumferential, or partly circumferential grooves cannot be molded easily into the middle of the end-capping member. The reason for not having the circumferential grooves go completely around the outside wall of the end-capping means is not to weaken the wall of the end-capping member to a failure point when in use. As shown in the figures, a reinforcing external rib is desirable to strengthen this structure, and therefore the partly circumferential term is used here.

Other inventive features for molding the grooves slightly into the bore of the end-capping means are (a) to protect the thinned-wall membrane, (b) utilize more output from the LEDC per unit length by capturing more of its detonation, (c) create a fold in the wall of the bore for reactive substance to adhere to, and (d) create a crevice that may be filled with reactive substance, if desired, to assure the functionality of the receptor portion of the receptor-transmitter element.

In still another embodiment of this invention, the end-capping means or plug is used to seal the detonator directly acting as and replacing the extended shock tube of the detonator. The grommet itself, which is normally used to center the shock tube in the detonator and to provide a seal against the metallic walls of the detonator, may be extended to be the end-capping means described above, i.e., a grommet with a closed end and with a reactive substance coating the surface of its bore, wherein the grommet may have desirably cord retaining means against thinned-wall sections or membranes in it. In this invention, the end-capping means extends beyond the detonator shell but the shock tube of the detonator, if used, may terminate right at the end of the detonator, since the end-capping means, or detonator end plug is a shock tube per se, or a shock tube in situ, having the surface of its bore coated with a reactive substance. As described with the end-capping means of the tube, the external wall of the grommet, or detonator end-capping means, is made a receptor-transmitter element by thinning its walls to create initiation-sensitive regions, and has an LEDC holding means in initiation relationship with the thinned-wall sections, i.e., membranes, in the end capping plug. In one case, the bore may be straight or curved, ending at a thinned-wall membrane which surrounds the passageway for the LEDC, thus forming the receptor-transmitter element grooved into the end of the bore. In other cases where the end capping means is straight, it might have one or more circumferential, partly circumferential, or longitudinal grooves to put the LEDC in initiation relationship with the thinned-wall sections of this receptor-transmitter member. In another inventive application, a short pigtail of a standard detonator may be attached to an end-capping member to allow the use of LEDC of the desired low loading in the cord tunnel of the primer. Still, in another inventive detonator, the extended end-capping member of the detonator have with another extension at right angles to the detonator, and is bendable to allow the insertion of the extension in the cord tunnel of the primer and the shock tube detonator in its cavity in the primer.

The present hybrid system for initiating explosives, which combines an LEDC with a shock tube/detonator unit overcomes the problems encountered with heavy, disruptive detonating cords. Thus, measures customarily employed for protecting explosive charges in the bore hole from disruption or even premature detonation by these heavy cords need not be taken. Also, because the receptor-transmitter is in initiation-sensitive mode with respect to LEDC it is not necessary to locally enlarge the amount of explosive needed for initiation of the shock tube, e.g., with a boosting coupler or a higher-energy-load section, or with tightly made knots.

The detonation-impulse-transmitting assembly can be used to produce a primer assembly of the general type known in the aforementioned U.S. Pat. No. 4,718,345, the disclosure of which is incorporated herein by reference. In the primer assembly of the present invention, the shock tube/detonator unit, or the receptor-transmitter element and the thereto-affixed shock tube/detonator or delay detonator itself, replaces the explosive coupler and the percussion detonator in the primer shown in the prior art patent. The present invention is also an improvement over the aforementioned U.S. Pat. No. 4,527,482 and others, because (a) it uses an LEDC with about half of the core load of the disruptive 1.5 grams per meter (7 grains per foot), (b) it does not require the special adapter to be carried and used in the field, (c) the LEDC runs in the central cord tunnel eliminating the problems of slidability of the primer caused by placing the cord on the outside of the primer where, in many occasions, prevents the primer from sliding smoothly down to its destination and sometimes even getting stuck at the walls of the borehole, and (d) it eliminates the use of percussion, couplers and boosting devises.

One inventive application of this application is to thin the end of a short pigtail of the shock tube detonator for a few inches to make it initiation-sensitive by LEDC with the desired load, seal that end and run both the sensitized section of the shock tube pigtail and the LEDC with the desired low core load of about 0.5 grams per meter (2.4 grains per foot), i.e., Detaline® LEDC, in the central cord tunnel of the primer while placing the detonation in its cavity in the primer. Similarly, another application is to loop the end of the pigtail in a circle from about 3 to 10 millimeters (⅛ to ⅜ inches) in diameter and seal it to itself allowing the passage of the Detaline® cord in the looped pigtail, looped end of the pigtail, inserting the detonator in its cavity and passing the Detaline® through the central cord tunnel and through the looped and sensitized pigtail. Alternatively, these two applications and many more can be accomplished by manufacturing shock tube for detonator units, wherein the shock tube is made totally initiation-sensitive by having thin walls specifically designed for this invention, eliminating the stripping and the thinning process steps. This shock tube can be reinforced at only the sections that may be vulnerable to damage under cetain field conditions. Example of reinforcing the tube is slipping a short sleeve of a certain shape, straight, ninety degree angled or U-shaped over sections of the tube only where protection is needed and sensitized sections are not needed.

Still another embodiment of this invention is to use the hybrid shock tube/detonator unit, or the hybrid detonator itself, with surface connectors and in-hole detonators with LEDC wherein a less expensive detonator of the shock tube type can be used with all surface and all in-the-hole blasting as shown in the figures illustrating this invention.

Figure 7:
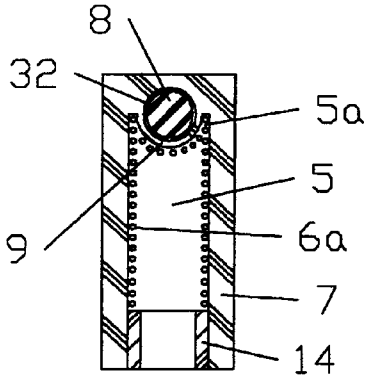
FIG. 7 is a longitudinal cross-sectional view of an end-capping member which is a shock receptor-transmitter element for use to seal open end shock tubes or detonators with LEDC in place at the thin membrane at the closed end of the end-capping member.
Figures 8, 9, 10:
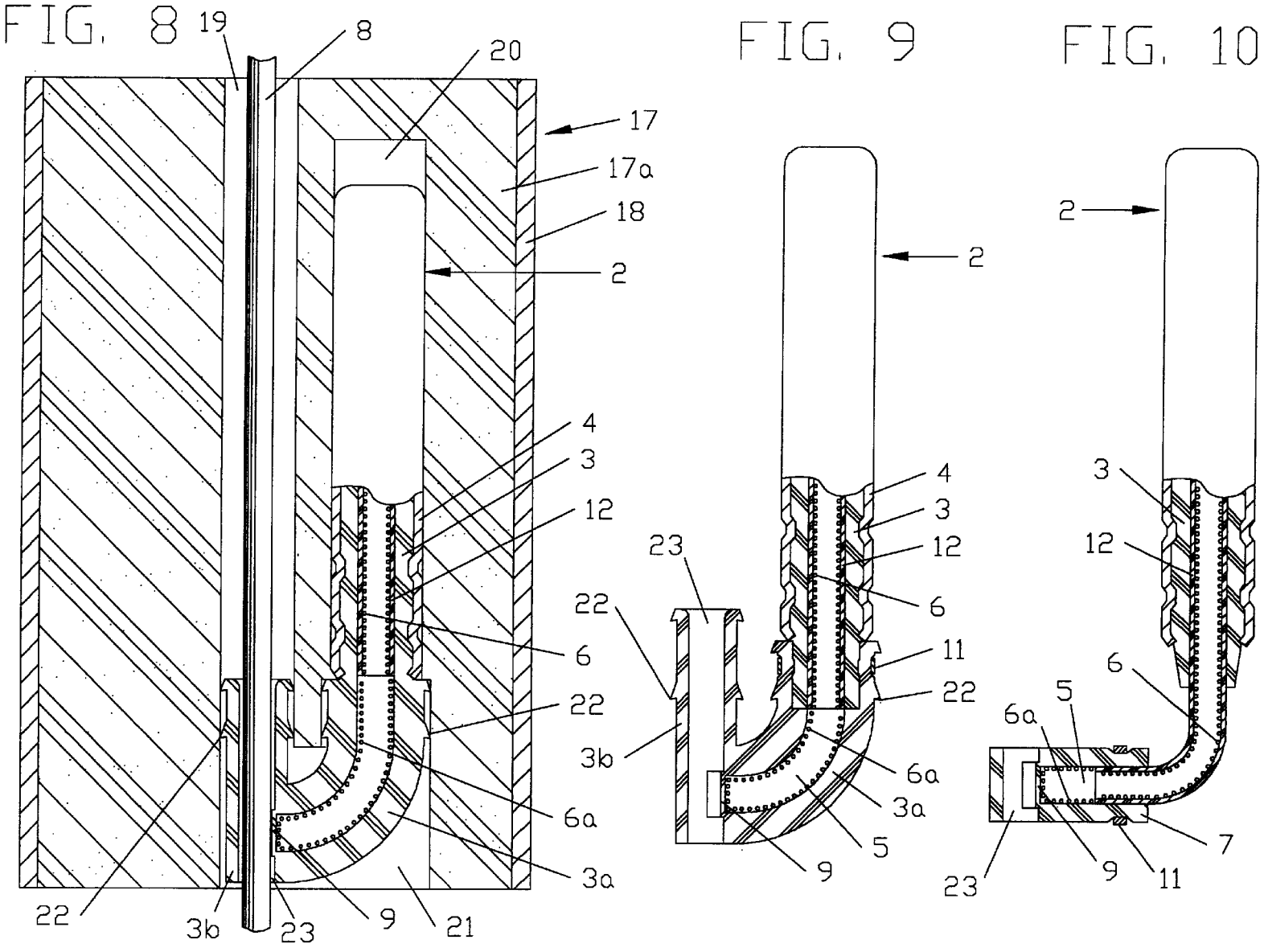
FIG. 8 is a cross-sectional view of a primer assembly of the invention including a shock tube/detonator unit of the invention having the shock tube housed within the bore of an extended grommet which holds the initiation-sensitive end surface of the shock tube adjacent a tubular grommet section adapted to receive a length of LEDC onto which the primer is threaded.
FIGS. 9 and 10 are partially cross-sectional views of other shock tube/detonator units of the invention adapted to be used as, for example, in the primer assembly shown in FIG. 8.

In the assembly shown in FIG. 1, a length of shock tube 1 has one of its end portions fitted into a standard shock tube detonator 2, thereby forming a shock tube/detonator unit, e.g., a unit sometimes known commercially as a Nonel Primadet®. The end of the shock tube 1 fits into an axial passageway in a deformable grommet 3, which is crimped into the open end of the detonator shell 4. The inner wall of the cylindrical bore 5 of end-capping member 7 is coated with a reactive substances 6, e.g., a detonating explosive composition, based on pentaerythritol tetranitrate and aluminum in 10:1 ratio by weight, which, in this case also coats the inner surface of plastic hollow tube 12. In other cases, the reactive substance 6 coating the surface of the inner wall of the bore 5 of end-capping member 7 may be a deflagrating composition based, for example, on a mixture of boron/red lead/silicon. The open end portion of shock tube 1 fits into the cylindrical bore 5 of cylindrical end-capping member 7, which is integrally closed at one end with membrane 9, thus allowing it to serve as a protective end-capping member for the open end of cord 12*e*. In this case, end-capping member 7 is also a cord-connecting means for positioning LEDC 8 in initiating relationship with the thinned wall, initiation sensitive membrane of the shock receptor-transmitter element, in this case, thin membrane 9 in connector 7, which is also the end-capping member. The closed end of the member 7, which may be made of plastic, contains a groove 47 so that it can slidably receive cord 8, placing the cord in a transverse position with respect to the axis of tube 1 and adjacent the groove bottom, where the end wall of connector/member 7 constitutes a thinned-wall, initiation sensitive membrane 9. Bore 5 may be any desired length since it is a shock tube per se, and its gas channel is continuous with the gas channel of the tube by virtue of its open end. Once this connector, which is the receptor-transmitter element of the system, is initiated via its initiation sensitive membrane, i.e., thinned-wall membrane 9, it will continue to propagate through shock tube 12 and initiate detonator 2. Cord-retention means 10 comprises a hinged lid that snaps into the end of connector member 7, and 11 is a metallic band which secures the tight fit between shock tube 1 and member 7. An alternative to temporary closure of the cord-receiving groove, e.g., by means of a hinged lid as shown, the cord-receiving groove may be permanently enclosed, thereby becoming a threading aperture as shown in FIGS. 7 and 10.

The positioning of the donor cord 8 in a cord retaining groove 47 puts the cord in initiation relationship with thinned-wall initiation sensitive membrane of the receptor-transmitter element. When the LEDC detonates, the resulting pressure wave is received by the receptor-transmitter element thin membrane 9 and is propagated by the internal gas channel of bore 5 into the gas channel of the shock tube, through the shock tube open cut end 12*e* and rest of the tube whereby detonator 2 is actuated. Use of the foregoing assembly to transmit a detonation impulse to an explosive charge in a borehole is shown in FIG. 2 wherein a length of LEDC 8 is a trunkline on the surface of the earth with five different connections: A, B, C to shock tube downlines are shown; and D to a shock tube surface connector; and E to LEDC downline. Connection A is made by attaching cord 8 to end-capping cord-connecting means 7, which has shock tube 1 in place therein as shown in FIG. 1. Shock tube 1 is a downline in borehole 13. When detonator 2 is actuated by the pressure pulse related thereto from the shock tube, an explosive charge (not shown) in borehole 13 detonates.

In FIG. 1, groove 47 is molded slightly into bore 5. This makes a circular crevice 5*a* which traps more reactive powder for improved initiation reliability by the LEDC 8. This crevice may be enlarged to be a semi-annular pocket for containing reactive powder by having bore 5 with a slightly larger diameter than that needed to accommodate the shock tube and adding a sleeve as shown in FIG. 3.

In a typical instance, the FIG. 1 assembly, end-capping member 7 is a block of preferably Surlyn®, a polyethylene ionomer with a salt or of other suitable material, and groove 47 is 3 millimeters wide and 3 millimeters deep, leaving a 0.3 millimeter-thick membrane 9. A typical shock tube 1 in this assembly is one having an outer diameter of 3 millimeters, and constructed of an outer layer of polyethylene and an inner layer of Surlyn®; and a typical LEDC is the cord described in U.S. Pat. No. 4,232,606, the explosive loading, for example, being about 0.5 grams per meter. The LEDC is substantially in contact with membrane 9.

The cord described in the above-mentioned U.S. Pat. No. 4,232,606 is a preferred low-energy detonating cord for use as the donor cord in the present assembly. The disclosure of this patent is incorporated herein by reference.

In a variation of the shock tube/cord-connector combination shown in FIG. 1, the unit shown in FIG. 3 is designed to provide a larger area and volume of space between the thinned-wall, initiation-sensitive membrane 9 and the bore 5 of the receptor-transmitter element. This space facilitates the rupturing of membrane 9 by the detonation of cord 8, sometimes desirable, and consequently the initiation of bore 5. In this case, membrane 9 is the closed end of end-capping member 7, the shock receptor-transmitter element, which is a capsule, e.g., made of metal, or plastic, having a larger inner diameter than the outer diameter of shock tube 1, thereby providing the larger-area space. Shock tube 1 fits snugly in the bore of plastic grommet 14, which is seated in capsule 7. The capsule in turn fits into the cylindrical bore of plastic cord-connecting member 15, which is open at both ends and contains an LEDC-receiving open slot 48 at one of its ends. The fit between shock tube 1 and grommet 14, capsule 7, and connector 15 is secured by band 11. In the view shown in FIG. 3A, membrane 9 is shown as having a thinner cross-shaped portion 9*a* emanating from its center to facilitate its rupturing. Other configurations for the thinned portion, e.g., diametric or circular, may be used to weaken the closed end of capsule 7 and enhance the rupturability of membrane 9. In this case, the inner wall surface of bore 5 is coated by a reactive substance 6 which is made more sensitive to initiation by the addition of a primary explosive as lead azide or the like to the deflagrating compound. A typical composition is, for example, 1.5/88.5/10 by weight of boron/red lead/dextrinated lead azide.

In the assembly shown in FIG. 4, end-capping capsule 7, the shock receptor-transmitter element is crimped to the end portion of a two-ply shock tube, consisting of outer layer 12*a* and inner layer 12*b*. The closed end of capsule 7, which constitutes membrane 9, has a thinner axial portion to facilitate its rupturing or transmitting the shock when a length of LEDC 8 detonates adjacent thereto. This hybrid shock tube/LEDC assembly with the end capping of the shock receptor-transmitter element, can be stored until needed, at which time it can be fitted in the field with open-ended cord-connecting member 15 by pushing it into the latter's cylindrical bore until it passes a set of retention teeth 46, whereupon membrane 9 reaches the LEDC-receiving open slot 48 at the end of member 13.

As an example of an assembly wherein the shock receptor-transmitter element is a shell and is an end-capped shock tube, the shell is placed in a separate connector, the assembly of FIG. 3 may have the end of shock tube 1 capped with a shell 7 made of Type 5052 aluminum having a 0.1-millimeter-thick bottom (i.e., membrane 9). Grommet 14, which centers shock tube 1 in shell 7 and the open end surface 12*e* of shock tube 1 is spaced from membrane 9 by any distance desired to make the connector easy to use since bore 5 is a shock tube per se. Shock tube 1 has an outer diameter of 3.2 millimeters and inner diameter of 1.3 millimeters, and shell 7 an inner diameter of 6.5 millimeters. The shock tube is single-ply shock tube coated on its inner surface with a 10:1 powder mixture by weight of HMX (cyclotetramethylenetetranitramine) and aluminum. Shell 7 is crimped onto grommet 14 and shock tube 1, and the unit inserted into a connector such as that shown in FIG. 4. Other connectors are shown in U.S. Pat. No. 4,248,152. LEDC 8 having an explosive loading of about 0.5 gram per meter (2.3 grains per foot) is fitted into slot 48 and is substantially in contact with membrane 9. If a thicker shell bottom is used, e.g., 0.4 millimeters, the LEDC explosive loading may be increased to 1.0 gram per meter (4.7 grains per foot).

Bore 5 shown in these connector or end-capping members, and in the following figures may be of the same, smaller or larger diameter than the outside diameter of the tube. Shell 7 may also be of a different material than connector 15, as shown in FIG. 3. Shell 7 is metallic; however, it may be made of plastics that have special properties, for example, adherence of reactive powders to its surface. Such plastics are known in shock tube manufacturing and multi-ply shock tubes with different plastics are also well known to manufacturers of shock tubes. Connector 15 and end-capping 7, or more generally, the inner surface of bore wall 5, may be prefabricated from such materials. Connector 15 may be molded over the end-capping means or shell 7 may be slipped on into connector 15 as shown in FIG. 4.

Figure 5:
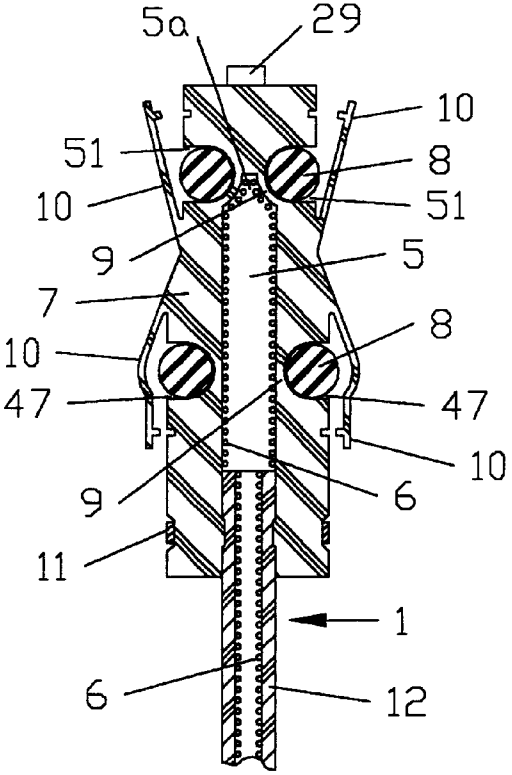
FIG. 5 is a longitudinal cross-sectional view of an assembly of a shock tube and an end-capping member with two LEDCs circumferentially in place adjacent a cord-connecting means in the side wall of the end-capping member.

The shock receptor-transmitter in FIG. 5 is an end-capping member 7 which is also a cord-connecting member, as is the case in the FIG. 1 assembly. However, member 7 in the FIG. 5 unit has two grooves in its outer wall, in contrast to that shown in FIG. 1, which has a groove at its closed end wall. In the FIG. 5 end-capping connecting member 7, a partially circumferentially placed grooves 47 and 51, adapted to receive two separate lengths of cord 8, one wrapped around groove 51 at the top, and the second around groove 47 at the middle of connector 7. The groove bottom(s), i.e., the portion(s) of the side wall of member 7 adjacent the groove(s), form the thin rupturable membrane (s) 9. In this embodiment, grooves 51 are at the top of bore 5, which has its internal surface coated with reactive substance 6, which in this case is a deflagrating composition. These grooves 51 are molded partly into bore 5 making a smaller crevice, 5*a* to increase the area of membrane 9, to capture more of the reactive substance, and to receive more of the energy of the LEDC, by the increased contact with it. The grooves are partially circumferential because of the presence of back rib 29 which runs along the back of the connector for reinforcement. As shown in FIG. 5, the substantially cylindrical bore in this case has its inner surface coated with a deflagrating composition (the reactive substance) 6, which is the same as that in tube 12, i.e., an RDX (cyclotrimethylenetrinitramine)/aluminum mix of 10:1 ratio by weight.

Figure 6:
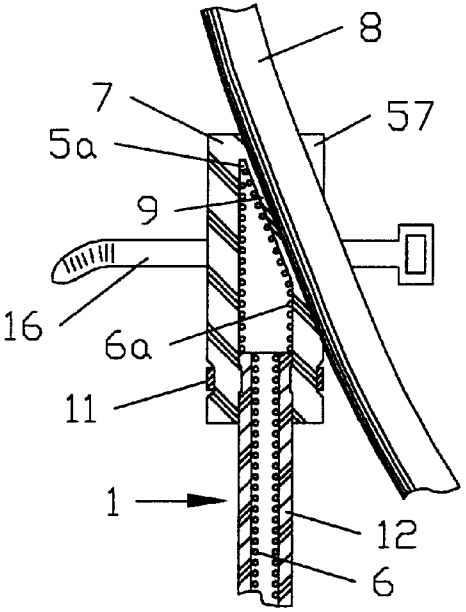
FIG. 6 is a longitudinal cross-sectional view of an assembly of a shock tube and an end-capping member with LEDC longitudinally in position to be connected to the side wall of the end-capping member.

The end-capping member 7 in the assembly shown in FIG. 6 also has a grooved side wall for receiving a length of LEDC 8. In this connector, bore 5 is essentially cylindrical and is coated with a deflagrating composition. At the site of the groove 57, which is longitudinal, the wall of member 7 is thinned down, thereby forming an initiation sensitive membrane 9. When a length of LEDC 8 is being positioned in the groove as shown, it is held adjacent membrane 9 by strap 16, which is a connecting member in this case. Groove 57 is molded partly in bore 5 to create crevice 5*a* and increase membrane area 9.

FIG. 7 shows an end-capping means of a shock receptor-transmitter element. This end-capping means 7 may be attached to the cut and open end of a shock tube or to an open end of a detonator. It is composed of a cylinder 7 with a closed end and a bore 5 which is also a cord connector by virtue of bore 32. It is molded of Surlyn®, polyethylene ionomer. Bore 5 is about 5.7 millimeters in diameter, about 50 millimeters long, and terminates halfway around LEDC receiving bore 32, making a crevice or a pocket 5*a*, of about 0.1 millimeters at its extreme ends, and leaving membrane 9 at about 0.3 millimeters thick. The diameter of the cord tunnel 32 is 2.9 millimeters. The outside diameter of the end-capping means is 12.2 millimeters. Sleeve 14 is of an elastomeric material 0.7 millimeters thick and 10 millimeters long. It is slipped in position in the bore 5 to be complete inside the bore. This end-capping means may be slipped over the shock tube and sealed by band 11 (shown in FIG. 1) to serve as an LEDC connector and a shock receptor-transmitter element.

A deflagrating composition of 50/50 titanium hydroxide/potassium perchlorate 6 was dumped in the bore of this end-capping means to coat the bore surface. It was closed, and the deflagrating composition shaken inside the bore slightly and was dumped out later to leave the surface of the walls of bore 5, including the membrane 9, coated with about 25 milligrams (about 30 milligrams per square meter) with the deflagrating composition 6. This receptor-transmitter element may be used as an end-capping means to a shock tube detonator if its outside diameter is enlarged to about 7 millimeters to fit inside the shell of an open shock tube detonator, one with a shock tube extending only to the top of the detonator shell. It also may be used as an end-capping means to a detonator without a shock tube in it by making the end-capping means longer to replace grommet 3 of the detonator shown in FIG. 1.

The amount of reactive substance may be sometimes filled into crevice 5*a* to assure initiation from the LEDC of about 0.5 gram per meter (2.3 grains per foot), especially in the cases where reactive substances do not adhere well to surface of bore 5.

The primer assembly of the invention shown in FIG. 8 incorporates a novel shock tube/detonator unit having a grommet that is shock receptor-transmitter element that extends beyond the shock-tube-receiving end of the detonator and has a passageway for slidably threading a length of LEDC adjacent the initiation-sensitive membrane located at the end of passageway in the grommet. In the primer assembly 17 is a substantially cylindrical explosive primer, typically formed from a cast explosive 17*a* of the kind commonly used in high-energy primers, e.g., the primer explosive described in U.S. Pat. No. 4,343,663. Primer 17 has a light peripheral wrap, 18, e.g., a cardboard tube into which explosive 17*a* has been cast. Primer 17 has an aperture or perforation 19 therethrough running parallel to, and coaxial with, its longitudinal cylindrical axis. Primer 17 also is provided with two cavities: a closed-end detonator-receiving cavity 20 separated from, and parallel to, perforation 19; and cavity 21, adjacent perforation 19 and cavity 20, and so conformed as to receive, together with perforation 19, an arcuate portion 3*a* of a grommet 3 that extends beyond the confines of detonator shell 4, seated in cavity 20.

In the shock tube/detonator unit, the shock tube fits into the axial passageway of grommet 3, as in the unit shown in FIG. 7. However, in FIG. 8, grommet 3, e.g., made of plastic, has a portion 3*a* which extends beyond the end of the detonator shell 4. The grommet portion 3*a* is curved, and the axial passageway in the grommet follows essentially the same curved path of the grommet body. Alternatively, grommet portion 3*a* may be an arm of an L-shaped grommet or a grommet that can be bent into the L-shape. The grommet passageway, which accommodated shock tube 1, ends at the mouth of the detonator shell. As shown in FIG. 8, the LEDC passageway 23 is also surrounded with the initiation sensitive membrane 9 which is molded as described in FIG. 7 and is located in the tubular section 3*b* of grommet 3, section 3*b* fitting into perforation 19 when detonator 2, with grommet 3, is in place in cavities 20 and 21. The bore 5 of grommet 3*b* is coated with a deflagrating composition e.g., a boron/red lead composition. Tubular section 3*b* (FIGS. 8 & 9 has a passageway 23 through which LEDC 8 passes when it is slidably threaded through cord tunnel 19. As LEDC 8 threads through section 3*b*, its wall is adjacent membrane 9. Grommet 3 is provided with gripping means 22 which enable the grommet to be retained in perforation 19 and cavity 20. In the primer assembly, a detonation impulse is transmitted from LEDC 8 to the receptor-transmitter element, which is the grommet in this case, to the shock tube/detonator unit, and thence to explosive 17*a*, as a result of the presence of initiation-sensitive membrane 9.

The shock tube/detonator unit depicted in FIG. 9 also is adapted for use in the FIG. 8 primer assembly. In this case, sections 3*a* and 3*b* of grommet 3 constitute a separate unit which can be attached to a tubular grommet section 3 as shown. Placement of a length of LEDC parallel to the axis of detonator shell 4 also can be accomplished with a shock tube/detonator unit having the shock tube positioned in a standard grommet as shown in FIG. 10. In this embodiment, a combination of a shock receptor-transmitter element of end-capping/cord-connecting member 7 having a cylindrical shock-tube-receiving bore and a LEDC-receiving passageway 23 normal to the bore axis is affixed to the end of the shock tube in the shock tube/detonator unit and the extended grommet caused to adopt an angle that places the LEDC-receiving passageway 23 parallel to the detonator shell axis. The wall of the bore 5 between membrane 9 and the shock tube end-surface is coated with reactive substance 6, as shown in FIG. 7.

In the FIG. 10 assembly, for example, end-capping/cord-connecting member 7 is a block made of EVA, and membrane 9 is formed by molding as discussed in FIG. 7. The distance between the end surface of the shock tube and membrane 9 is about 4 millimeters, and the wall of the bore 5 between the shock tube end surface and membrane 9 were coated with 6, a thin layer (about 20 grams per square meter) of a mixture of boron/red lead/silicon, thus essentially rendering the thus-coated member 7 into an extension of the portion of shock tube 1 seated in the first 5 millimeters of the connector bore. An LEDC downline threaded through passageway 23 is a cord known as Detaline® 0.5 gram/meter (2.3 grains per foot).

Figure 11:
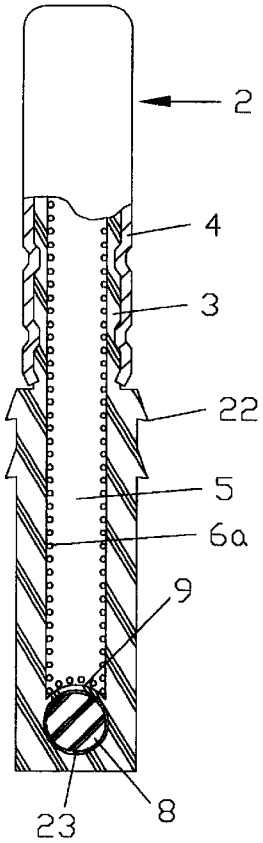
FIGS. 11, 12 and 13 are a partially cross-sectional view of a shock tube/detonator unit of the invention wherein the shock tube is an axially extended detonator grommet whose axial bore is coated with a reactive substance and which is adapted to hold a length of LEDC normal to the bore axis, circumferentially with respect to said axis, or with the cord's side wall alongside the thin-wall region in the grommet wall, respectively.

In the shock tube/detonator unit shown in FIG. 11, grommet 3, the shock receiver-transmitter element, extends beyond the end of detonator shell 4 in a manner such that that shock tube opening or passageway therein is coaxial with detonator shell 4 throughout the length of the grommet, and the passageway 23 that is adapted to receive a length of LEDC is oriented so as to enable the cord to be arrayed normal to the axis of shell 4. In the unit shown, plastic hollow shock tube 12 is omitted and reactive material of a deflagrating composition 6 is instead coated onto the wall of the axial passageway in grommet 3. In such a case, the grommet itself, by virtue of reactive coating 6, becomes a shock tube, which thus is in initiation-sensitive mode with respect to a length of LEDC to be positioned in passageway 23 adjacent thinned-wall membrane 9 within grommet 3. Bore 5 is about 3 millimeters to increase effectiveness of initiation.

The design by which passageway 23 is surrounded by thin-walled membrane 9 which is coated with the reactive composition, is very effective in utilizing lower energy cords, as Detaline® of 0.5 grams per meter, to initiate these connectors with the LEDC at right angles to the bore of the connector or receptor-transmitter element.

Figure 12:
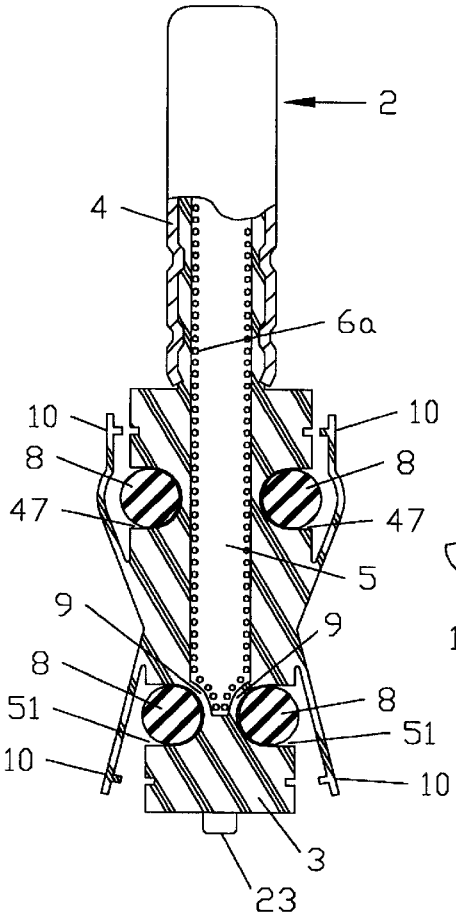

In FIG. 12, the detonator is constructed exactly like in FIG. 11, except that the initiation sensitive region, or thin-walled membrane 9, is partly circumferential for focal output from the LEDC. The connector is described in FIG. 5 which has two partly circumferential grooves, 51 and 47 for connecting to LEDC. The upper LEDC grooves 51 is molded into the upper portion of bore 5 increasing the effectiveness of the shock wave transmission element of this design. Two different LEDCs can be used: one in each side of the groove, or one in each set of the grooves. This feature may be of great advantage in surface blasting if the invention is used as a surface connector where two independent LEDCs increase initiation reliability tremendously, especially when two-pass system is employed. Bore 5 was coated with a deflagrating composition 6.

Figure 13:
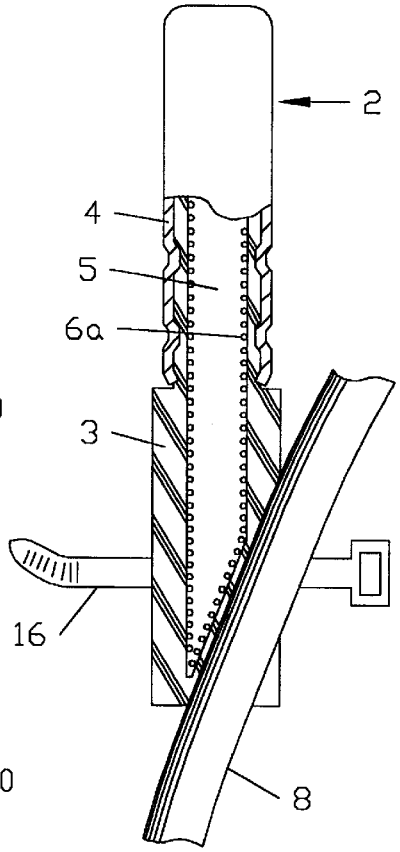

Detonators in FIGS. 11, 12 and 13 can be used in other connecting bodies for specific end uses as in surface connectors. Also, these detonators in FIGS. 11, 12 and 13 may be inserted in cap sensitive explosives, like chubs and dynamite.

In FIG. 13, the detonator is constructed exactly like in FIG. 11, except that the initiation sensitive region, a thin-walled membrane is longitudinal as described in FIG. 6. In this case, the upper portion of bore 5 is substantially circumferential because the longitudinal groove is molded partly into bore 5 coated with a deflagrating composition as shown.

Figure 14:
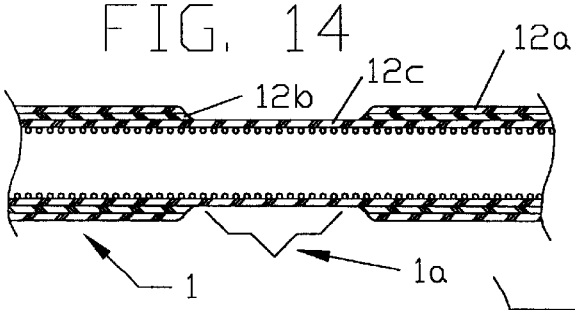
FIG. 14 is a longitudinal cross-sectional view of a shock tube of the invention having a circumferential thinned-wall initiation-sensitive region.

In FIG. 14, shock tube 1 is a triple-ply tube whose wall consists of an inner layer 12*c*, a middle layer 12*b*, and an outer layer 12*a*. Powdered reactive material 6 lines the wall of inner layer 12*c*. In the section of the tube denoted by 1*a*, the shock tube wall is thinned down to layer 12*c* only, which is the receptor-transmitter element of the shock tube. The single-layer portion is circumferential and sensitive to initiation by the side output of LEDC, e.g., by a length of LEDC wrapped circumferentially around portion 1*a*, or around which portion 1*a* of the shock tube is wrapped. The minimum thickness of 12*c* will depend on the strength of the material from which it is formed, but generally it will be at least about 0.25 millimeters to assure the integrity of the shock tube. The maximum thickness of layer 12*c* will depend on the explosive loading of the LEDC to be used. Layer 12*c* can be up to about 0.8 millimeters thick with an LEDC loading at the upper end of the 1.0 to 1.3 grams range, thinner layers being used with lower-strength donor cords. A preferred thickness range for the thinned-wall portion of the shock tube is about from 0.25 to 0.5 millimeters.

Figure 17:
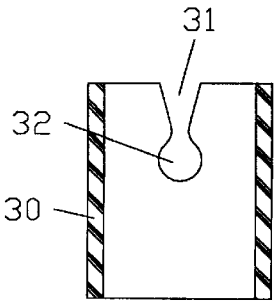
FIGS. 17, 17A and 17B are perspective views in partial cross-section of a connector, of a shock tube wrapped over LEDC and of LEDC wrapped over a shock tube, respectively, with the initiation-sensitive regions of the shock tube next to the LEDC.
Figure 15:
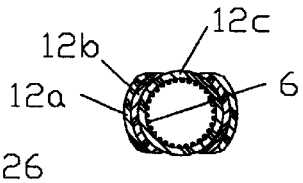
FIG. 15 is a transverse cross-sectional view of a shock tube of this invention with two opposite sides with thinned walls.

In FIG. 15, the same cord as described in FIG. 14 has been shaved in two opposite sides, only exposing two thinned-wall initiation sensitive sections at opposite ends of the shock tube. These two shock receptor-transmitter sections of the shock tube may be initiated by two different cords for certain applications, especially in surface blasting where either side-by-side initiation of LEDC to shock tube or by wrapping shock tube around LEDC or wrapping LEDC around the shock tube are feasible as shown in FIG. 17.

Figure 17A:
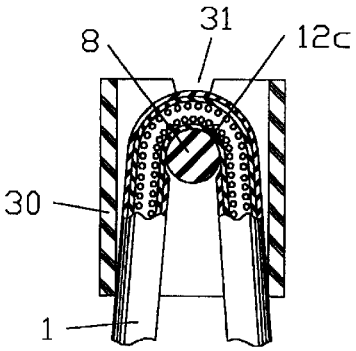
Figure 17B:
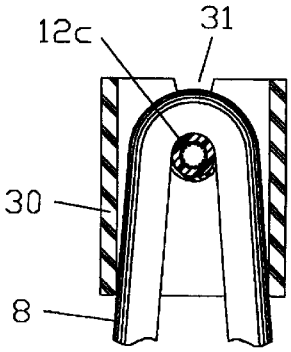
Figure 16:
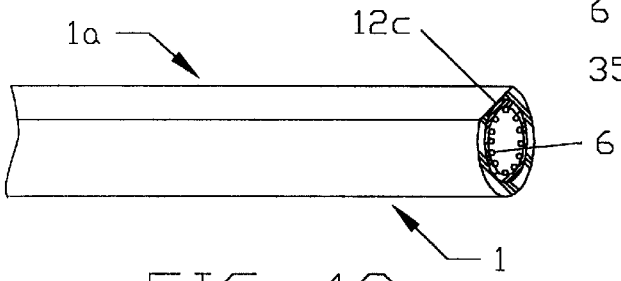
FIGS. 16 and 18 are perspective views of a shock tube of the invention having longitudinal and spiral thinned-wall regions, respectively.

In FIG. 16, only one side of the shock tube is shaved down for either side-by-side initiation form LEDC side cord output, or from wrapping the initiation-sensitive area of the shock tube over the LEDC or visa versa. This figure shows a single-ply shock tube 1 which is made initiation sensitive from side output of LEDC by removing some of the wall thickness 1*a* at only the desired initiation spots, leaving layer 12*c* as the thin membrane. In FIGS. 17, 17A, and 17B an effective way to utilize LEDC cord output radially or focally to initiate the shock tube with initiation sensitive membrane is shown. FIG. 17 is a plastic or metallic cylinder 30 about 7 millimeters inside diameter, 50 millimeters long. It has two V-slots 31 placed symmetrically on two opposite sides each leading to a round hole 32 about 3 millimeters in diameter. In FIG. 17A, the LEDC 8 is placed in hole 32 via V-slots 31 and shock tube 1 is wrapped around LEDC 8, with its shock receptor-transmitter against the LEDC. The initiation in this case is by radial shock transmission of energy form the LEDC. In FIG. 17B, the shock tube 1 is placed in hole 32 and the LEDC 8 is wrapped around the sensitized section of the shock which is initiated through its shock receptor-transmitter element by focal shock transmitter of energy from LEDC.

Figure 19:
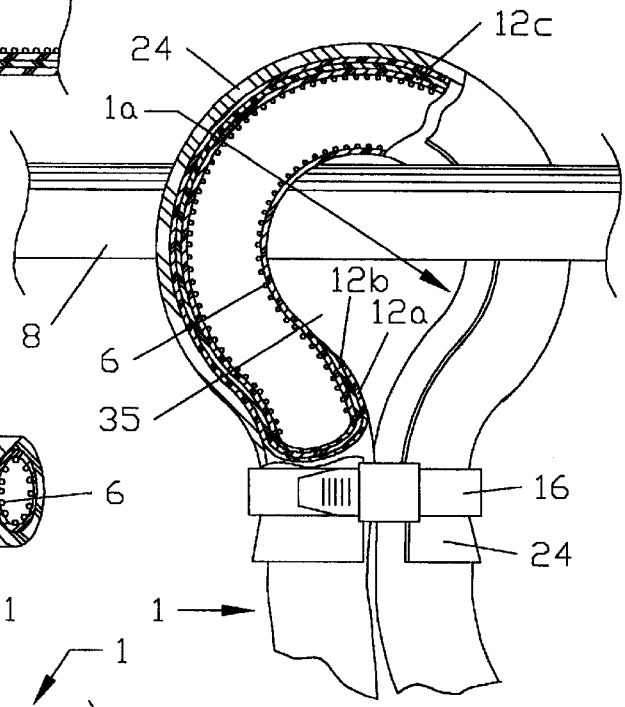
FIG. 19 is a perspective view in partial cross-section of a shock tube having a reinforced, partially circumferential thinned-wall region held adjacent the wall of a length of LEDC.

In FIG. 19, a length of triple-ply shock tube 1 whose wall consists of an inner layer 12*c*, the initiation sensitive membrane known as 9, a middle layer 12*b*, and an outer layer 12*a* has a section 1*a* wherein a single-ply wall portion consisting of layer 12*c* occupies about one-half of the tube circumference, i.e., a portion of shock tube 1 in section 1*a* has a wall which is semi-circumferentially single-ply and semi-circumferentially triple-ply. Beyond the bounds of this section, the tube wall is totally triple-ply. The shock tube is looped around a length of LEDC 8 and held in the looped position by strap 16, which secures the two joined arms of the loop in the portions of the tube having a totally triple-ply wall. A layer of reinforcing material 24, e.g., made of cloth, plastic, or thin metal, is partially wrapped around the periphery of tube 1, leaving approximately one-fourth of the circumference of the tube wall uncovered, and thus capable of being exposed directly to the wall of the LEDC threaded through the loop aperture of shock tube 1.

The single-ply portion of the tube wall in tube section 1*a* is not covered by reinforcing layer 24. Section 1*a* is folded back on itself to form the loop in a manner such that the exposed single-ply portion in that section is inside the loop and will be exposed to, and able to contact, the wall of LEDC 8. The presence of layer 24 around the remaining three-fourths of 7the wall periphery of tube 1 is useful to ensure the integrity of section 1*a* should a downward pull be exerted on it.

Figure 20:
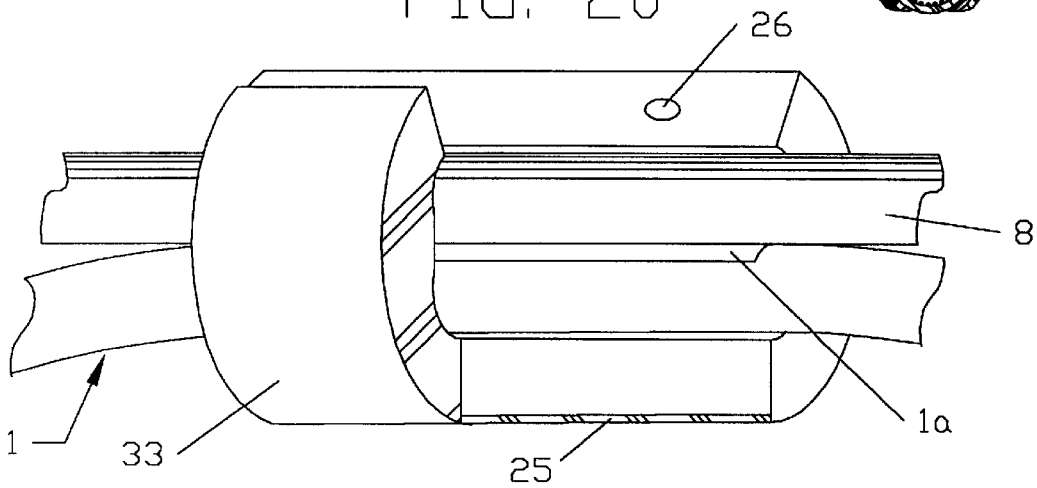
FIG. 20 is a perspective view in partial cross-section of the shock tube of FIG. 16 held in a cord connector with its thinned-wall region adjacent the wall of a length of LEDC.

In FIG. 20, a length of LEDC 8 is held against portion 1*a* of the FIG. 16 shock tube by snap-on cord connector 33, which has two matching half-portions appropriately grooved to hold LEDC 8 and shock tube 1 in place when the portions are snapped together. These two halves are hinged at 25, and have matching holes, e.g., 26, and pins (not shown) to assure proper closure.

Figure 18:
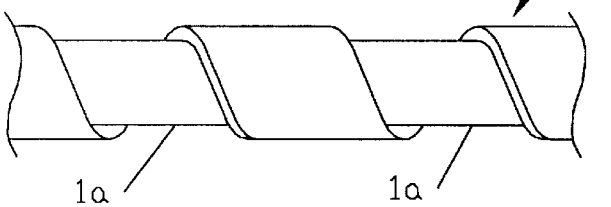
Figure 21:
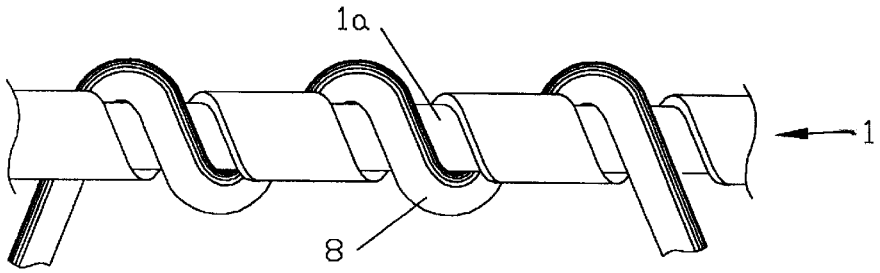
FIG. 21 is a perspective view of an assembly of the invention in which a length of LEDC is wound around the spiral thinned-wall region of the shock tube shown in FIG. 18.

The shock tube of the invention shown in FIG. 18 has a thinned-wall portion 1*a* in the form of a spiral. This tube may be employed in the hybrid system of the invention by winding a length of LEDC 8 spirally in portion 1*a*, as shown in FIG. 21, or by wrapping it spirally against the LEDC.

Figure 22:
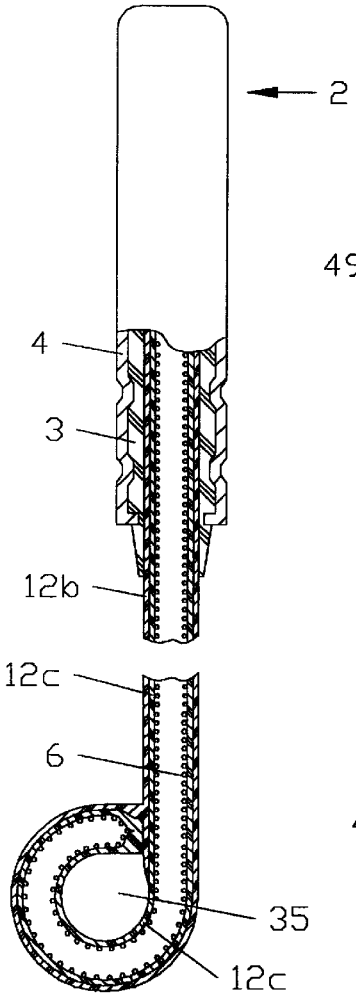
FIG. 22 is a cross-sectional view of shock tube of the invention having a turned-back end portion in which the tube wall within the resulting closed loop is thinned down so that when the shock tube is attached to a shock tube detonator of the invention, as shown, it is sensitive to initiation from the side output of a length of LEDC when threaded through the loop.

In the shock tube/detonator unit shown in FIG. 22, the shock tube of the invention is a two-ply tube made up of inner layer 12*c* and outer layer 12*b*. The end portion of tube 1 that emerges from detonator 2 is turned back upon itself to form a closed loop, and the loop structure maintained by fusing the end surface to the outer surface of the tube. The aperture 35 of the closed loop is intended to function as a means for positioning a length of LEDC in initiating relationship with the initiation-sensitive region of the shock tube. For this reason, the wall of the shock tube in the portion which lines aperture 35 is thinned-down, consisting only of layer 12*c*, the initiation sensitive membrane of the shock receptor-transmitter element, in contrast to the remainder, which consists of layers 12*b* and 12*c*. This thinning-down may be accomplished by forming the loop with the two-ply tube, and thereafter melting away, or stripping, outer layer 12*b* in the portion within aperture 35.

When layer 12*c* in the shock tube shown in FIG. 22 is 0.3 millimeters thick polyethylene ionomer, the shock tube is initiated by the detonation of a length of 0.5 grams per meter Detaline®, an extruded LEDC, having an outer diameter of 2.5 millimeters threaded through a loop having an aperture diameter of about 5 millimeters. Double loops worked well even with 0.4 grams per meter Detaline® which had plastic cover up to 2.0 millimeters diameter.

Figure 23:
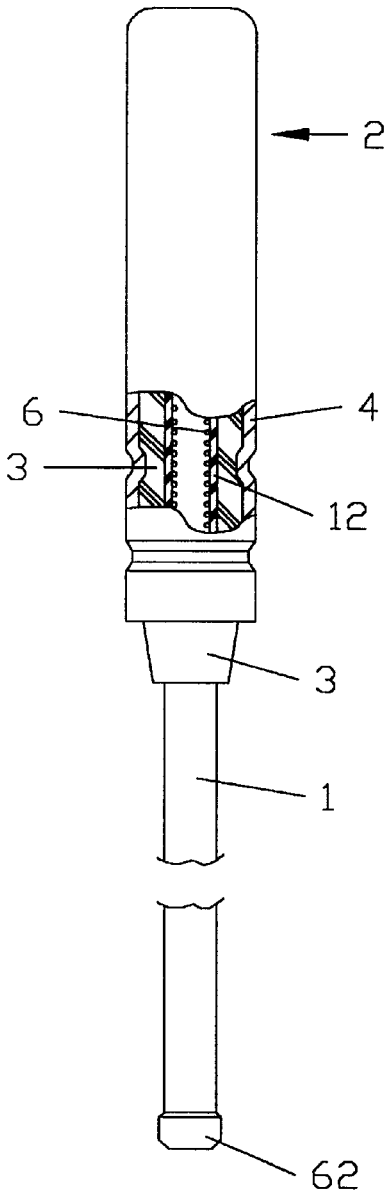
FIGS. 23, 23A, 23B and 23C are partial cross-sectional views of detonators with a shock tube thinned along all its length for use with LEDC.
Figure 23A:
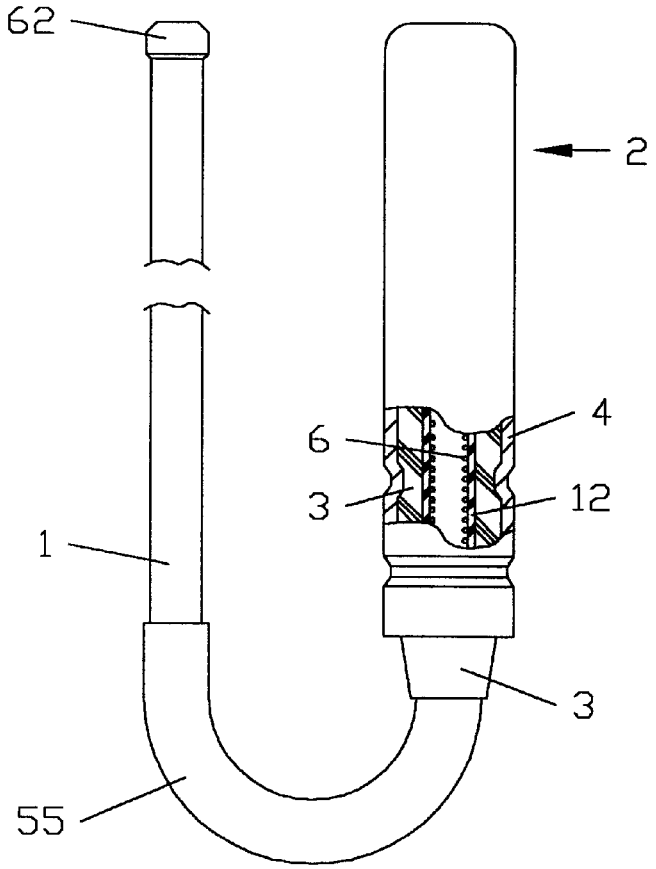
Figure 23C:
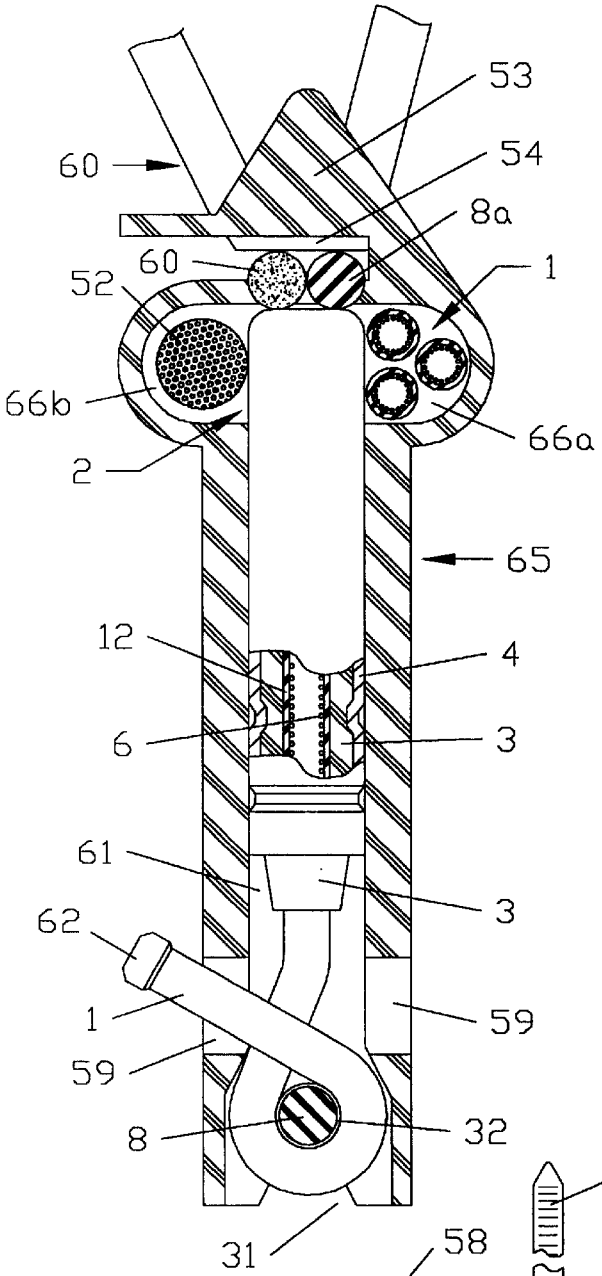
Figure 23B:
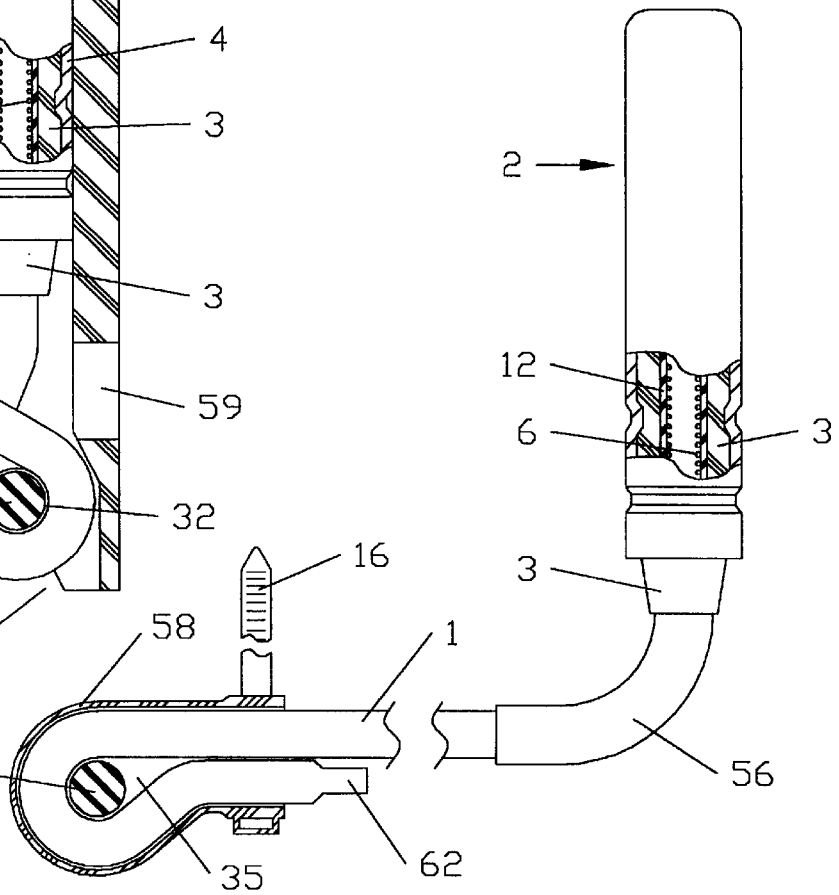

In FIGS. 23A, 23B, and 23C, the detonator unit is standard in all aspects, except for the use of a shock tube 1 manufactured originally with a single thin-ply of Surlyn®, a polyethylene ionomer 12*a*, which has a wall thickness of about 0.25 to 0.5 millimeters, for example, about 2.0 millimeters outside diameter and 1.3 millimeters inside diameter and 0.35 millimeters wall thickness. The surface of the inner wall is coated with 10:1 PETN/aluminum mixture. The shock tube has a length of about 6 inches sealed at its end 62. There are three applications of this invention as illustrated in FIGS. 23A, 23B and 23C. The purpose of the totally thinned shock tube is precision and ease of manufacturing the thinned-wall initiation-sensitive sections of the shock tube for use with LEDC of 1 gram per meter of explosive core loading and lower. One reason for having the commercial, presently used shock tube totally reinforced is to be sure that it performs under all field conditions, and therefore the use of higher energy detonating cords. In order for this thinned-wall initiation sensitive shock tube to perform in its intended end uses, special inventive ideas are shown: in FIG. 23A, a metallic or plastic means, in this case, tube 55, is slipped over the shock tube before sealing the end 62. It may be secured under grommet 3 to shape the tube in U-figure or 180 degrees for use with LEDC, for example, in the internal cord tunnel of primers. This reinforces the shock tube at the vulnerable section leaving the rest of it in initiation sensitive mode. Alternatively, grommet 3 is extended and possibly molded in U-shape to do the same effect. These protective sleeves or tubes could be split down one side to be slipped over the shock tube any time. These measures will prevent pinching of the shock tube, especially when used in the standard primers without cavities joining the cord tunnel cavity with the detonator cavity. Such pinching may stop the propagation in the shock tube before reaching the detonator.

In FIG. 23B, the protective means is a tube with a 90 degree angle 56 or an extended grommet 3 at 90 degrees. A tie strap 16 attached to a reinforcing ring 58 used to make loop 35 of the shock tube for the LEDC to pass through. The detonator is seated in its cavity in a primer and the LEDC passes through the cord tunnel and through loop 35.

Strap 58 is similar to strap 24 shown in FIG. 19. In this case, the end of the shock tube 1 is made into a circle for the LEDC 8 to pass through allowing slidability of the LEDC and at the same time protecting the shock tube from damage during its use. The position of the loop can be adjusted in the field, since this strap is partially wrapped around the periphery of tube 1, leaving approximately one-fourth of the circumference of shock tube wall 1 uncovered, thus exposing the initiation-sensitive tube to the LEDC while protecting the rest of the tube from external damage.

In FIG. 23C, a novel surface connector showing a hybrid shock tube detonator unit 2, as shown in FIG. 23 designed to be initiated by LEDC and to initiate other cords, is inserted into connector body 65 where detonator 2 is press fitted into bore 61. The top of the connector has arrangement as in cylinder 30 of FIG. 17 for looping a shock tube over LEDC through V-slot 31 and hole 32. In addition, it has two symmetrical slots on its side 59 to take the excess length of the initiation sensitive shock tube. As shipped to the field, the shock tube pigtail will be extending out from the open end of connector. In the field, the LEDC is pressed into position in both holes 32 via V-slot 31. Shock tube 1 is then wrapped around the LEDC and pulled out through window 59 to make a complete circle around the LEDC, thus to be initiated by radial output of the LEDC. Connector 59 has means to hold different types of cords for initiation from the detonator output. For example, Detaline® cord 8*a* and Primaline® cord 60 were placed under the base end of the detonator 2 retained in U-shaped position by rib 54 of hinge 53. Three shock tubes 1 are inserted in cord threading hole 66*a* and one high energy detonating cord 52 in other threading hole 66*b*. The initiation of the shock tube by LEDC and the detonator by its shock tube and the initiation of a combination of shock tubes, Detaline® cord and other cords make a truly hybrid shock tube/LEDC system.

Figure 24:
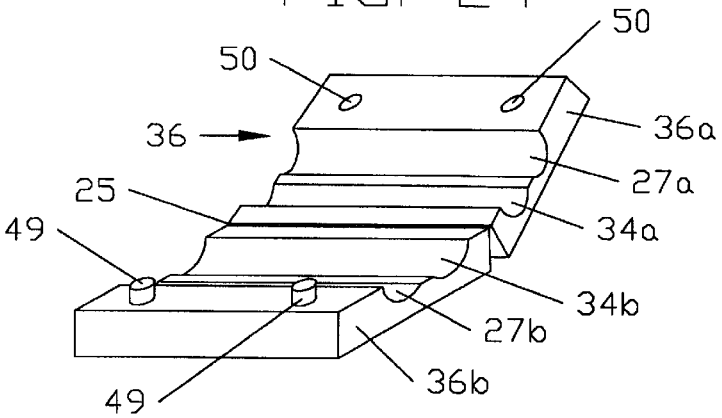

Plastic connectors 36 and 37 (shown in FIGS. 24 and 25, respectively) have two matching half portions (36*a*/36*b* and 37*a*/37*b*, respectively) joined together at hinge 25. Connector halves 36*a* and 36*b* have a matching pair of grooves 27*a* and 27*b* to receive and hold a length of shock tube or LEDC; and a matching pair of grooves 34*a* and 34*b* to receive and hold a length of the cord or tube which is not held in grooves 27*a*/27*b*. Connector halves 37*a* and 37*b* have three matching pairs of grooves; i.e., 46*a* and 46*b*, 47*a* and 47*b*, and 48*a* and 48*b*, to receive and hold one length of LEDC (in grooves 47*a*/47*b*) and two lengths of shock tube. The wall partition between each pair of grooves is reduced sufficiently to allow communication between the shock tube and LEDC therein. When the two halves of each connector are snapped closed (by the mating of a pair of pins 49 in 36*b* and 37*b* with a pair of holes 50 and 36*a* and 37*a*), the LEDC and shock tube(s) is held side-by-side in the connectors with a thinned-wall portion 1*a* of the shock tube(s) adjacent the wall of the LEDC.

Connections B, C and D of shock tube downlines to an LEDC surface trunkline in FIG. 2 utilize cord connectors which hold the LEDC in different initiation modes with respect to one or more shock tubes having a shock receptor-transmitter elements with different thinned-wall initiation-sensitive regions according to the present invention. Connection B may be made from a single length of shock tube 1 having a shock tube detonator 2 attached to one end portion and another shock tube detonator 2 attached to the other end portion. The length of shock tube has a thinned-wall region at its approximate center. This region of shock tube is placed in the connector 30 shown as FIG. 17A over the LEDC trunkline. One-half of the shock tube and the detonator 2 attached thereto are placed in borehole 38, and the other half and the detonator 2 attached thereto are placed in borehole 39.

Figure 25:
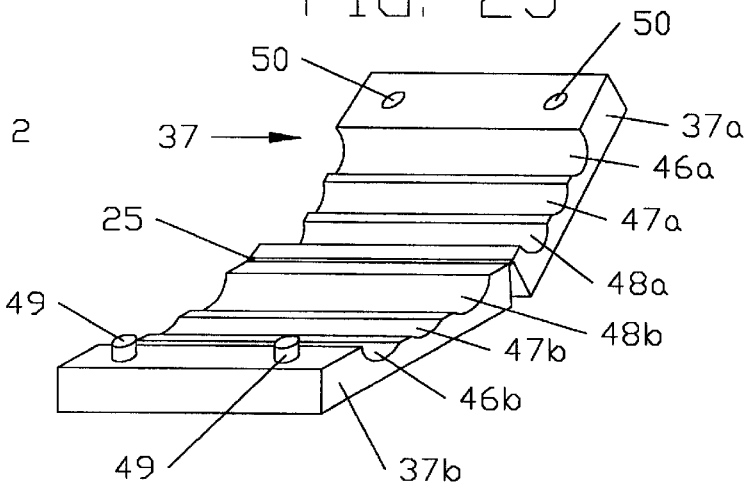
FIGS. 24 and 25 are perspective views of snap-on cord connectors adapted to accomplish connections B, C, and D in the FIG. 2 assemblies.

Connector 37, shown in FIG. 25, can be used to make connection C. Snap-on connector 37 is adapted to position the thinned-wall regions of two shock tubes 1 alongside the portion of LEDC trunkline where connection C is desired. This allows a shock tube and detonator to be placed in borehole 40, and another shock tube and detonator to be placed in borehole 41.

Connection D is described in FIG. 23C. The Detaline® downline is lowered into borehole 42 and the Primaline® downline in borehole 43. These downlines will initiate other explosive charges by virtue of more hybrid shock tube/LEDC assemblies, so does the Detaline® trunkline as it terminates in borehole 44 as a downline. The Detaline® downline in borehole 42 goes through a cord tunnel of a primer, which has a shock tube detonator as described in FIG. 22, seated in its detonator cavity and through the initiation-sensitive loop 35. In borehole 43, the Primaline® goes through the primer which has a detonator described in FIG. 23A, inserted in the detonator cavity and its thinned-wall initiation sensitive receptor-transmitter pigtail in the cord tunnel adjacent the Primaline®; of course, either downline works with either primer setup. The Detaline® in borehole 44 terminates in a detonator as described in FIG. 10, which may be inserted in cap sensitive water gel cartridge, as an example.

I claim:

1. An assembly for transmitting a detonation impulse to an explosive charge non-electrically comprising:

(a) a donor element comprising a length of low energy detonating cord (LEDC) having an axial continuous core of a detonating explosive composition containing about from 0.1 to 1.3 grams of crystalline high explosive per meter length;

(b) a shock receptor-transmitter element comprising a tubular member adapted to accept and propagate a pressure wave within a gas channel, said tubular member including an elongated hollow tube forming said gas channel and having a wall coated on its inner surface with a reactive substance, wherein at least one section of said wall is thinned to form a membrane which is sensitive to initiation by the detonation of said LEDC when positioned in initiation relationship thereto, the thickness of said initiation-sensitive membrane being about from 0.1 to 0.8 millimeter;

(c) connecting means for positioning said length of LEDC in initiation relationship with the initiation-sensitive membrane of said shock receptor-transmitter element; and (d) a detonator attached to an end of the shock receptor-transmitter element.

2. An assembly of claim 1 wherein said LEDC has an explosive loading of about from 0.2 to 1.0 gram per meter of cord length.

3. An assembly of claim 1 wherein the reactive substance coated on the inner surface of said tube wall is a detonating or deflagrating explosive composition.

4. An assembly of claim 1 wherein said tubular member is a length of shock tube, and said initiation-sensitive membrane is formed in the side wall of said shock tube.

5. An assembly of claim 4 wherein said shock tube, substantially throughout its length, has the wall thickness of said initiation-sensitive membrane, and has a reinforcement layer applied to its outer surface leaving at least one exposed initiation-sensitive membrane.

6. An assembly of claim 1 wherein said tubular member of said shock receptor-transmitter element comprises a tubular end-capping member fitted on an end and open portion of a shock tube comprising a length of low-energy fuse which (1) propagates a pressure wave within a gas channel, (2) includes an elongated hollow tube forming said gas channel, and (3) has a wall coated on its inner surface with a reactive substance, said end-capping member having an elongated hollow bore communicating with the gas channel in said shock tube and terminating at a closed end of the end-capping member, the wall of said end-capping member being coated interiorly with a reactive substance and having said initiation-sensitive membrane formed therein.

7. An assembly of claim 6 wherein the reactive substance coated on the wall of said end-capping member is a detonating or deflagrating explosive composition.

8. An assembly of claim 6 wherein at least one longitudinal initiation-sensitive membrane is formed in the side wall of said tubular end-capping member.

9. An assembly of claim 6 wherein at least one initiation-sensitive membrane is formed circumferentially in the wall of said tubular end-capping member.

10. An assembly of claim 6 wherein at least one initiation-sensitive membrane is formed in the wall at the closed end of said tubular end-capping member.

11. An assembly of claim 6 wherein the reactive substance coated on the wall of said tubular end-capping member is detonating or deflagrating explosive composition.

12. An assembly of claim 1 wherein said shock receptor-transmitter element comprises a tubular end-capping member forming a closure for said detonator at its actuation end, said end-capping member having an elongated hollow bore terminating at a closed end and having a wall which is coated interiorly with a reactive substance, said initiation-sensitive membrane being formed in the wall of said tubular end-capping member at said closed end.

13. An assembly of claim 12 wherein said tubular end-capping member is attached to the detonator body in a manner such that its hollow bore communicates with a bore in a grommet component of the detonator at its actuation end, said grommet being coated interiorly with a reactive substance.

14. An assembly of claim 12 wherein said tubular end-capping member fits onto an open end of a length of shock tube which extends from said detonator body and is held therein by a hollow grommet component.

15. A shock tube assembly adapted to be initiated by a low energy detonating cord (LEDC) comprising:

(a) a shock tube comprising a length of low energy fuse which propagates a pressure wave within a gas channel, said fuse including an elongated hollow tube having a wall coated on its inner surface with a reactive substance, said shock tube constituting a shock receptor-transmitter element, at least one section of said shock tube having a thinned wall forming a membrane which is sensitive to initiation by the detonation of LEDC when said LEDC is positioned in initiation relationship thereto, the thickness of said initiation-sensitive membrane being about from 0.1 to 0.8 millimeter;

(b) connecting means for holding said LEDC in initiation relationship with said initiation-sensitive membrane; and (c) at least one shock tube detonator attached to an end of said shock tube for initiation by said shock receptor-transmitter element.

16. A shock tube assembly of claim 15 wherein the reactive substance coated on the inner surface of said tube wall is a detonating or deflagrating explosive composition.

17. A shock tube assembly of claim 15 wherein said membrane is sensitive to initiation by the detonation of LEDC having an explosive loading of about from 0.1 to 2.3 grams per meter of cord length.

18. An assembly of claim 15 wherein at least one shock tube with at least one initiation-sensitive membrane in said shock tube wall is positioned and retained longitudinally adjacent to an LEDC in initiation relationship by the side output of the LEDC.

19. An assembly of claim 15 wherein said shock tube has at least one portion containing at least one section that includes said initiation-sensitive membrane, said portion being turned back upon itself to form a loop adapted to receive a length of LEDC, the initiation-sensitive membrane in said section being positioned inside said loop so as to be adjacent a length of LEDC to be passed through said loop for the initiation of said shock tube at said initiation-sensitive membrane by the LEDC's side output.

20. An assembly of claim 19 wherein said loop which is adapted to receive said length of LEDC has a diameter of about from 3 to 10 millimeters.

21. An assembly of claim 20 fitted into a substantially cylindrical explosive primer having a detonator-receiving cavity and an axial detonating-cord-receiving tunnel therein, the shock tube detonator of said assembly being seated in said detonator-receiving cavity and the LEDC through the detonating-cord-receiving tunnel and through the shock tube loop wherein a protective band is used to secure and protect the loop.

22. An assembly of claim 15 wherein the wall of said shock tube is thinned along substantially the entire length thereof, said shock tube having at least one section covered with protective and wall-reinforcing means and at least one uncovered section, said uncovered section being sensitive, and said covered section insensitive, to initiation by the side output of LEDC.

23. An assembly of claim 22 fitted into a substantially cylindrical explosive primer having a detonator-receiving cavity and an axial detonating-cord-receiving tunnel therein, the shock tube detonator of said assembly being seated in said detonator-receiving cavity and the thin-wall shock tube containing the initiation-sensitive membrane is in the detonating-cord-receiving tunnel, and wherein a U-shaped protective sleeve may be slipped over the shock tube portion between the detonator and the start of the cord tunnel.

24. An assembly of claim 22 wherein the shock tube detonator is inserted in a connector for initiating other detonating cords and shock tubes.

25. An assembly of claim 15 wherein at least one length of LEDC is looped at least once around one or more initiation-sensitive membranes in initiation relationship thereto.

* * * * *